US005509978A

United States Patent [19]

Masumoto et al.

[11] Patent Number: 5,509,978

[45] Date of Patent: Apr. 23, 1996

[54] HIGH STRENGTH AND ANTI-CORROSIVE ALUMINUM-BASED ALLOY

[75] Inventors: Tsuyoshi Masumoto; Akihisa Inoue, both of Sendai; Yuma Horio, Hamamatsu, all of Japan

[73] Assignee: Yamaha Corporation, Japan

[21] Appl. No.: 385,915

[22] Filed: Feb. 9, 1995

Related U.S. Application Data

[63] Continuation-in-part of Ser. No. 101,948, Aug. 4, 1993, abandoned.

[30] Foreign Application Priority Data

| | | | |
|---|---|---|---|
| Aug. 5, 1992 | [JP] | Japan | 4-209115 |
| Aug. 5, 1992 | [JP] | Japan | 4-209116 |
| Mar. 2, 1993 | [JP] | Japan | 5-041528 |

[51] Int. Cl.[6] ..... C22C 21/00

[52] U.S. Cl. ..... 148/403; 148/437; 148/438; 420/528; 420/538; 420/550; 420/551; 420/552; 420/553

[58] Field of Search ..... 148/403, 437, 148/438; 420/528, 538, 550, 551, 552, 553

[56] References Cited

U.S. PATENT DOCUMENTS

| | | | |
|---|---|---|---|
| 4,595,429 | 6/1986 | Le Caér et al. | 148/403 |
| 5,368,658 | 11/1994 | Masumoto et al. | 148/403 |

*Primary Examiner*—David A. Simmons
*Assistant Examiner*—Robert R. Koehler
*Attorney, Agent, or Firm*—Ostrolenk, Faber, Gerb & Soffen

[57] ABSTRACT

The present invention provides a high strength and anti-corrosive aluminum-based alloy essentially consisting of an amorphous structure or a multiphase amorphous/fine crystalline structure, which is represented by the general formula $Al_xM_yR_z$. In this formula, M represents at least one metal element selected from the group consisting of Ti, V, Cr, Mn, Fe, Co, Cu, Zr, Nb, Mo and Ni, and R represents at least one element or mixture selected from the group consisting of Y, Ce, La, Nd and Mm (misch metal). Additionally, in the formula, x, y and z represent the composition ratio, and are atomic percentages satisfying the relationships of $x+y+z=100$, $64.5 \leqq x \leqq 95$, $5 \leqq y \leqq 35$, and $0<z \leqq 0.4$.

18 Claims, 34 Drawing Sheets

HIGH STRENGTH AND ANTI-CORROSIVE ALUMINUM-BASED ALLOY

CROSS-REFERENCE TO RELATED APPLICATION

This is a continuation-in-part of application Ser. No. 08/101,948, filed Aug. 4, 1993 now abandoned.

BACKGROUND OF THE INVENTION

1. Field of the Invention

The present invention relates to an aluminum-based alloy for use in a wide range of applications such as in aircraft, vehicles and ships, as well as, in the structural material for the engine portions thereof. In addition, the present invention may be employed as sash, roofing material and exterior material for use in construction, or as material for use in sea water equipment, nuclear reactors, and the like.

2. Description of Related Art

As prior art aluminum-based alloys, alloys incorporating various components such as Al—Cu, Al—Si, Al—Mg, Al—Cu—Si, Al—Cu—Mg, and Al—Zn—Mg are known. In all of the aforementioned, superior anti-corrosive properties are obtained at a light weight, and thus the aforementioned alloys are being widely used as structural material for machines in vehicles, ships and aircraft, in addition to being employed as sash, roofing material, exterior material for use in construction, structural material for use in LNG tanks, and the like.

However, the prior art aluminum-based alloys generally exhibit disadvantages such as a low hardness and poor heat resistance when compared to material incorporating Fe. In addition, although some materials have incorporated elements such as Cu, Mg and Zn for increased hardness, disadvantages remain such as low anti-corrosive properties.

On the other hand, recently, experiments are being conducted in which the compositions of aluminum-based alloys are being refined by means of performing quench solidification from a liquid-melt state resulting in the production of superior mechanical strength and anti-corrosive properties.

In Japanese Patent Application First Publication No. 1-275732, an aluminum-based alloy is disclosed which can be utilized as material with a high hardness, high strength, high electrical resistance, anti-abrasion properties, or as soldering material. In addition, the disclosed aluminum-based alloy has a superior heat resistance, and may undergo extruding or press processing by utilizing the superplastic phenomenon observed near liquid crystallization temperatures. This aluminum-based alloy comprises a composition AlM*X with a special composition ratio (wherein M* signifies an element such as V, Cr, Mn, Fe, Co, Ni, Cu, Zr and the like, and X represents a rare earth element such as La, Ce, Sm and Nd, or an element such as Y, Nb, Ta, Mm (misch metal) and the like), and has an amorphous or a combined amorphous/fine crystalline structure.

However, this aluminum-based alloy is disadvantageous in that high costs result from the incorporation of large amounts of expensive rare earth elements and/or metal elements with a high activity such as Y. In addition to the aforementioned use of expensive raw materials, problems also arise such as increased consumption and labor costs due to the large scale of the manufacturing facilities required to treat materials with high activities. Furthermore, the aforementioned aluminum-based alloy tends to display insufficient resistance to oxidation and corrosion.

SUMMARY OF THE INVENTION

It is an object of the present invention to provide an aluminum-based alloy, possessing superior strength and anti-corrosive properties, which comprises a composition in which the incorporated amount of high activity elements such as Y or expensive elements such as rare earth elements is restricted to a small amount, or in which such elements are not incorporated at all, thereby effectively reducing the cost, as well as, the activity described in the aforementioned.

In order to solve the aforementioned problems, the first aspect of the present invention provides an aluminum-based alloy, essentially consisting of an amorphous structure or a multiphase amorphous/fine crystalline structure, represented by the general formula $Al_xM_yR_z$ (wherein M is at least one metal element selected from the group consisting of Ti, V, Cr, Mn, Fe, Co, Cu, Zr, Nb, Mo and Ni, and R is at least one element or mixture selected from the group consisting of Y, Ce, La, Nd and Mm (misch metal)). In the formula, x, y and z represent the composition ratio, and are atomic percentages satisfying the relationships of $x+y+z=100$, $64.5 \leqq x \leqq 95$, $5<y \leqq 35$, and $0<z \leqq 0.4$.

The second aspect of the present invention provides an aluminum-based alloy, essentially consisting of an amorphous structure or a multiphase amorphous/fine crystalline structure, represented by the general formula $Al_xNi_yM'$ z (wherein M' is at least one metal element selected from the group consisting of Ti, V, Mn, Fe, Co, Cu and Zr). In the formula, x, y and z represent the composition ratio, and are atomic percentages satisfying the relationships of $x+y+z=100$, $50 \leqq x \leqq 95$, $0.5 \leqq y \leqq 35$, and $0.5 \leqq z \leqq 20$.

According to the third aspect of the present invention, the fine crystalline component of the multiphase structure described in the aforementioned first and second aspects comprises at least one phase selected from the group consisting of an aluminum phase, a stable or metastable intermetallic compound phase, and a metal solid solution comprising an aluminum matrix. The individual crystal diameter of this fine crystalline component is approximately 30 to 50 nm.

The fourth aspect of the present invention provides an aluminum-based alloy represented by the general formula $Al_xCo_yM''_z$ (wherein M"is at least one metal element selected from the group consisting of Mn, Fe and Cu). In the formula, x, y and z represent the composition ratio, and are atomic percentages satisfying the relationships of $x+y+z=100$, $50 \leqq x \leqq 95$, $0.5 \leqq y \leqq 35$, and $0.5 \leqq z \leqq 20$.

The fifth aspect of the present invention provides an aluminum-based alloy represented by the general formula $Al_aFe_bL_c$ (wherein L is at least one metal element selected from the group consisting of Mn and Cu). In the formula, a, b and c represent the composition ratio, and are atomic percentages satisfying the relationships of $a+b+c=100$, $50 \leqq a \leqq 95$, $0.5 \leqq b \leqq 35$, and $0.5 \leqq c \leqq 20$.

The sixth aspect of the present invention substitutes Ti or Zr in place of element M"or L, in an amount corresponding to one-half or less of the atomic percentage of M" or L.

In the aforementioned aluminium-based alloy according to the present invention represented by the formula $Al_xM_yR_z$, the atomic percentages of Al, element M, and element R are restricted to 64.5–95%, 5–35% and 0–0.4%, respectively. This is due to the fact that when the composition of any of the aforementioned elements fall outside these specified ranges, it becomes difficult to form an amorphous component, as well as a supersaturated solid solution in which the amount of solute exceeds the critical solid solubility; this, in turn, results in the objective of the present invention, an aluminum-based alloy having an amorphous structure, an amorphous/fine crystalline complex structure or a fine crystalline structure, being unobtainable using an industrial quenching process incorporating a liquid quenching method and the like.

In addition, when diverging from the aforementioned composition ranges, it becomes difficult to obtain an amorphous phase for use in producing the fine crystalline complex structure, through crystallization of the amorphous phase produced by the quenching method using an appropriate heating process, or temperature control of a powder molding process which utilizes conventional powder metallurgy technology.

Element M, which represents one or more metal elements selected from the group consisting of Ti, V, Cr, Mn, Fe, Co, Cu, Zr, Nb, Mo and Ni, coexists with R and improves the amorphous forming properties, as well as, raising the crystallization temperature of the amorphous phase. Most importantly, this element markedly improves the hardness and strength of the amorphous phase.

As well, under the fine crystal manufacturing conditions, these elements also stabilize the fine crystalline phase, form stable or metastable intermetallic compounds with aluminum or other additional elements, disperse uniformly in the aluminum matrix (α-phase), phenomenally increase the hardness and strength of the alloy, suppress coarsening of the fine crystal at high temperatures, and impart a resistance to heat.

Furthermore, an atomic percentage for element M of less than 5% is undesirable, as this reduces the strength and hardness of the alloy. On the other hand, an atomic percentage exceeding 35% is also undesirable as this results in intermetallic compounds forming easily, which in turn lead to embrittlement of the alloy.

Element R is one or more elements selected from the group consisting of Y, Ce, La, Nd and Mm (misch metal).

In general, a misch metal mainly comprises La and/or Ce, and may also include additional complexes incorporating other rare earth metals, excluding the aforementioned La and Ce, as well as unavoidable impurities (Si, Fe, Mg, etc.).

In particular, element R enhances the amorphous forming properties, and also raises the crystallization temperature of the amorphous phase. In this manner, the anti-corrosive properties can be improved, and the amorphous phase can be stabilized up to a high temperature. In addition, under the fine crystalline alloy manufacturing conditions, element R coexists with element M, and stabilizes the fine crystalline phase.

Furthermore, an atomic percentage of element R exceeding 0.4% is undesirable as this results in the alloy being easily oxidized in addition to increased costs.

In the aforementioned aluminium-based alloy according to the present invention represented by the formula $Al_xNiyM'_z$, the atomic percentages of Al, Ni, and element M' are restricted to 50–95%, 0.5–35% and 0.5–20%, respectively. This is due to the fact that when the composition of any of the aforementioned elements fall outside these specified ranges, it becomes difficult to form an amorphous component, as well as a supersaturated solid solution in which the amount of solute exceeds the critical solid solubility; this, in turn, results in the objective of the present invention, an aluminum-based alloy having an amorphous structure, an amorphous/fine crystalline complex structure or a fine crystalline structure, being unobtainable using an industrial quenching process incorporating a liquid quenching method.

In addition, when diverging from the aforementioned composition ranges, it becomes difficult to obtain an amorphous phase for use in producing the fine crystalline complex structure, through crystallization of the amorphous phase produced by the quenching method using an appropriate heating process, or temperature control of a powder molding process which utilizes conventional powder metallurgy technology.

An atomic percentage for Al of less than 50% is undesirable, as this results in significant embrittlement of the alloy. On the other hand, an atomic percentage for Al exceeding 95% is also undesirable, as this results in reduction of the strength and hardness of the alloy.

Additionally, in the aforementioned composition ratio, the atomic percentage for Ni is within the range of 0.5–35%. If the incorporated amount of Ni is less than 0.5%, the strength and hardness of the alloy are reduced. On the other hand, an atomic percentage exceeding 35% results in intermetallic compounds forming easily, which in turn leads to embrittlement of the alloy. Thus both of these situations are undesirable.

Furthermore, in the aforementioned composition ratio, the atomic percentage for element M' lies within the range of 0.5–20%. As in the aforementioned, if the incorporated amount of M' is less than 0.5%, the strength and hardness of the alloy are reduced. While, on the other hand, an atomic percentage exceeding 20% results in embrittlement of the alloy. Both of these situations are likewise undesirable.

Element M' coexists with other elements, and improves the amorphous forming properties, in addition to raising the crystallization temperature of the amorphous phase. Most importantly, this element phenomenally improves the hardness and strength of the amorphous phase. As well, under the fine crystal manufacturing conditions, element M' also stabilizes the fine crystalline phase, forms stable or metastable intermetallic compounds with aluminum or other additional elements, disperses uniformly in the aluminum matrix (α-phase), phenomenally increases the hardness and strength of the alloy, suppresses coarsening of the fine crystal at high temperatures, and imparts a resistance to heat.

In the aforementioned aluminium-based alloys according to the present invention represented by the formulae $Al_xCo_yM''z$ and $Al_aFe_bL_c$, by adding predetermined amounts of Co and/or Fe to Al, the effect of quenching is enhanced, the amorphous and fine crystalline phases are more easily obtained, and the thermal stability of the overall structure is improved. In addition, the strength and hardness of the resulting alloy are also increased.

In addition, by adding predetermined amounts of Mn and/or Cu to alloys consisting essentially of Al—$Co_2$ or Al—$Fe_2$, the strength and hardness of these alloys may be further improved.

Furthermore, by adding predetermined amounts of Ti and/or Zr, the effect of quenching is enhanced, the amorphous and fine crystalline phases are more easily obtained, and the thermal stability of the overall structure is improved.

The atomic percentage of Al is in the 50–95% range. An atomic percentage for Al of less than 50% is undesirable, as this results in embrittlement of the alloy. On the other hand, an atomic percentage for Al exceeding 95% is also undesirable, as this results in reduction of the strength and hardness of the alloy.

Correspondingly, the atomic percentage of Co and/or Fe lies in the 0.5–35% range. When the atomic percentage of the aforementioned falls below 0.5%, the strength and hardness are not improved, while, on the other hand, when this atomic percentage exceeds 35%, embrittlement is observed, and the strength and toughness are reduced. Furthermore, in the case when Fe is added to an alloy comprising Al—$Co_2$, if the atomic percentage exceeds 20%, embrittlement of the alloy begins to occur.

The atomic percentage of Mn (manganese) and/or Cu (copper) lies in the 0.5–20% range. When the atomic percentage of the aforementioned falls below 0.5%, improvements in the strength and hardness are not observed, while, on the other hand, when this atomic percentage exceeds 20%, embrittlement occurs, and the strength and toughness are reduced.

The atomic percentage of Ti (titanium) and/or Zr (zirconium) lies in the range of up to one-half the atomic percentage of element M" or L. When the aforementioned atomic percentage is less than 0.5%, the quench effect is not improved, and, in the case when a crystalline state is incorporated into the alloy composition, the crystalline grains are not finely crystallized. On the other hand, when this atomic percentage exceeds 10%, embrittlement occurs, and toughness is reduced. In addition, the melting point rises, and melting become difficult to achieve. Furthermore, the viscosity of the liquid-melt increases, and thus, at the time of manufacturing, it becomes difficult to discharge this liquid-melt from the nozzle.

In addition, when Ti or Zr is substituted in an amount exceeding one-half of the specified amount of element M", the hardness, strength and toughness are accordingly reduced.

All of the aforementioned aluminum-based alloys according to the present invention can be manufactured by quench solidification of the alloy liquid-melts having the aforementioned compositions using a liquid quenching method.

This liquid quenching method essentially entails rapid cooling of the melted alloy. Single roll, double roll, and submerged rotational spin methods have proved to be particularly effective. In these aforementioned methods, a cooling rate of $10^4$ to $10^6$ K/sec is easily obtainable.

In order to manufacture a thin tape (alloy) using the aforementioned single or double roll methods, the liquid-melt is first poured into a storage vessel such as a silica tube, and then discharged, via a nozzle aperture at the tip of the silica tube, towards a copper roll of diameter 30 to 300 mm, which is rotating at a fixed velocity in the range of 300 to 1000 rpm. In this manner, various types of thin tapes of thickness 5–500 μm and width 1–300 mm can be easily obtained.

On the other hand, fine wire-thin material can be easily obtained through the submerged rotational spin method by discharging the liquid-melt in order to quench it, via the nozzle aperture, into a refrigerant solution layer of depth 1 to 10 cm, maintained by means of centrifugal force inside an air drum rotating at 50 to 500 rpm, under argon gas back pressure. In this case, the angle between the liquid-melt discharged from the nozzle, and the refrigerant surface is preferably 60° C. to 90° C., and the relative velocity ratio of the the liquid-melt and the refrigerant surface is preferably 0.7 to 0.9.

In addition, thin layers of aluminum-based alloy of the aforementioned compositions can also be obtained without using the above methods, by employing layer formation processes such as the sputtering method. In addition, aluminum alloy powder of the aforementioned compositions can be obtained by quenching the liquid-melt using various atomizer and spray methods such as a high pressure gas spray method. In the following, examples of structural states of the aluminum alloy obtained using the aforementioned methods are listed.

(1) Non-crystalline phase;

(2) Multiphase structure comprising an amorphous/Al fine crystalline phase;

(3) Multiphase structure comprising an amorphous/stable or metastable intermetallic compound phase;

(4) Multiphase structure comprising an Al/stable or metastable intermetallic compound or amorphous phase; and (5) Solid solution comprising a matrix of Al.

The fine crystalline phase of the present invention represents a crystalline phase in which the crystal particles have an average maximum diameter of 1 μm. The properties of the alloys possessing the aforementioned structural states are described in the following.

An alloy of the structural state (amorphous phase) described in (1) above has a high strength, superior bending ductility, and a high toughness. Alloys possessing the structural phases (multiphase structures) described in (2) and (3) above have a high strength which is greater than that of the alloys of (amorphous) structural state (1) by a factor of 1.2 to 1.5. Alloys possessing the structural phases (multiphase structure and solid solution) described in (4) and (5) above have a greater toughness and higher strength than that of the alloys of structural states (1), (2) and (3).

Each of the aforementioned structural states can be determined by a normal X-ray diffraction method or by observation using a transmission electron microscope.

In the case of an amorphous phase, a halo pattern characteristic of this amorphous phase is evident. In the case of a multiphase structure comprising an amorphous/fine crystalline phase, a diffraction pattern formed from a halo pattern and characteristic diffraction peak, attributed to the fine crystalline phase, is displayed. In the case of a multiphase structure comprising an amorphous/intermetallic compound phase, a pattern formed from a halo pattern and characteristic diffraction peak, attributed to the intermetallic compound phase, is displayed.

These amorphous and fine crystalline substances, as well as, amorphous/fine crystalline complexes can be obtained by means of various methods such as the aforementioned single and double roll methods, submerged rotational spin method, sputtering method, various atomizer methods, spray method, mechanical alloying method and the like.

In addition, the amorphous/fine crystalline multiphase can be obtained by selecting the appropriate manufacturing conditions as necessary.

By regulating the cooling rate of the alloy liquid-melt, any of the structural states described in (1) to (3) above can be obtained.

By quenching the alloy liquid-melt of the Al-rich structure (e.g. structures with an Al atomic percentage of 92% or greater), any of the structural states described in (4) and (5) can be obtained.

Subsequently, when the aforementioned amorphous phase structure is heated above a specific temperature, it decomposes to form crystal. This specific temperature is referred to as the crystallization temperature.

By utilizing this heat decomposition of the amorphous phase, a complex of an aluminum solid solution phase in the fine crystalline state and different types of intermetallic compounds, determined by the alloy compositions therein, can be obtained.

The aluminum-based alloy of the present invention displays superplasticity at temperatures near the crystallization temperature (crystallization temperature ±100° C.), as well as, at the high temperatures within the fine crystalline stable temperature range, and thus processes such as extruding, pressing and hot forging can easily be performed. Consequently, aluminum-based alloys of the above-mentioned compositions obtained in the aforementioned thin tape, wire, plate and/or powder states can be easily formed into bulk materials by means of extruding, pressing and hot forging processes at the aforementioned temperatures. Furthermore, the aluminum-based alloys of the aforementioned compositions possess a high ductility, thus bending of 180° is also possible.

As well, the aluminum-based alloys having an amorphous phase or an amorphous/fine crystalline multiphase structure according to the present invention do not display structural or chemical non-uniformity of crystal grain boundary, segregation and the like, as seen in crystalline alloys. These alloys cause passivation due to formation of an aluminum oxide layer, and thus display a high resistance to corrosion.

In particular, disadvantages exist when incorporating rare earth elements: due to the activity of these rare earth elements, non-uniformity occurs easily in the passive layer on the alloy surface resulting in the progress of corrosion from this portion towards the interior. However, since the alloys of the present invention do not incorporate rare earth elements, these aforementioned problems are effectively circumvented.

In regards to the aluminum-based alloy of the present invention, the manufacturing of bulk-shaped (mass) material will now be explained.

When heating the aluminum-based alloy according to the present invention, precipitation and crystallization of the fine crystalline phase is accompanied by precipitation of the aluminum matrix (α-phase), and when further heating beyond this temperature, the intermetallic compound also precipitates. Utilizing this property, bulk material possessing a high strength and ductility can be obtained.

Concretely, the tape alloy manufactured by means of the aforementioned quench process is pulverized in a ball mill, and then powder pressed in a vacuum hot press under vacuum (e.g. $10^{-3}$ Torr) at a temperature slightly below the crystallization temperature (e.g. approximately 470K), thereby forming a billet for use in extruding with a diameter and length of several centimeters. This billet is set inside a container of an extruder, and is maintained at a temperature slightly greater than the crystallization temperature for several tens of minutes. Extruded materials can then be obtained in desired shapes such as round bars, etc. by extruding.

Consequently, the aluminum-based alloy according to the present invention is useful as materials with a high strength, hardness and resistance to corrosion. Furthermore, it is possible to improve the mechanical properties by heat treatment; this alloy also stands up well to bending, and thus possesses superior properties such as the ability to be mechanically processed.

In this manner, based on the aforementioned, the aluminum-based alloys according to the present invention can be used in a wide range of applications such as in aircraft, vehicles and ships, as well as, in the structural material for the engine portions thereof. In addition, the aluminum-based alloys of the present invention may also be employed as sash, roofing material and exterior material for use in construction, or as material for use in sea water equipment, nuclear reactors, and the like.

BRIEF DESCRIPTION OF THE DRAWINGS

FIG. 32 is a graph showing variation of the tensile rupture strength of alloys having the compositions of $Al_aFe_{97-a}L_3$ and $Al_aFe_{85-a}L_3$ corresponding to various values of a.

FIG. 35 is a graph showing variation of the tensile rupture strength of alloys having the compositions of $Al_{88}Co_6M''_{6(1-a)}Zr_{6a}$ corresponding to various values of a.

FIG. 36 is a graph showing variation of the tensile rupture strength of alloys having the compositions of $Al_{88}Co_6M''_{6(1-a)}Ti_{6a}$ corresponding to various values of a.

DETAILED DESCRIPTION OF THE PREFERRED EMBODIMENTS

[First Preferred Embodiment]

Figure 1:
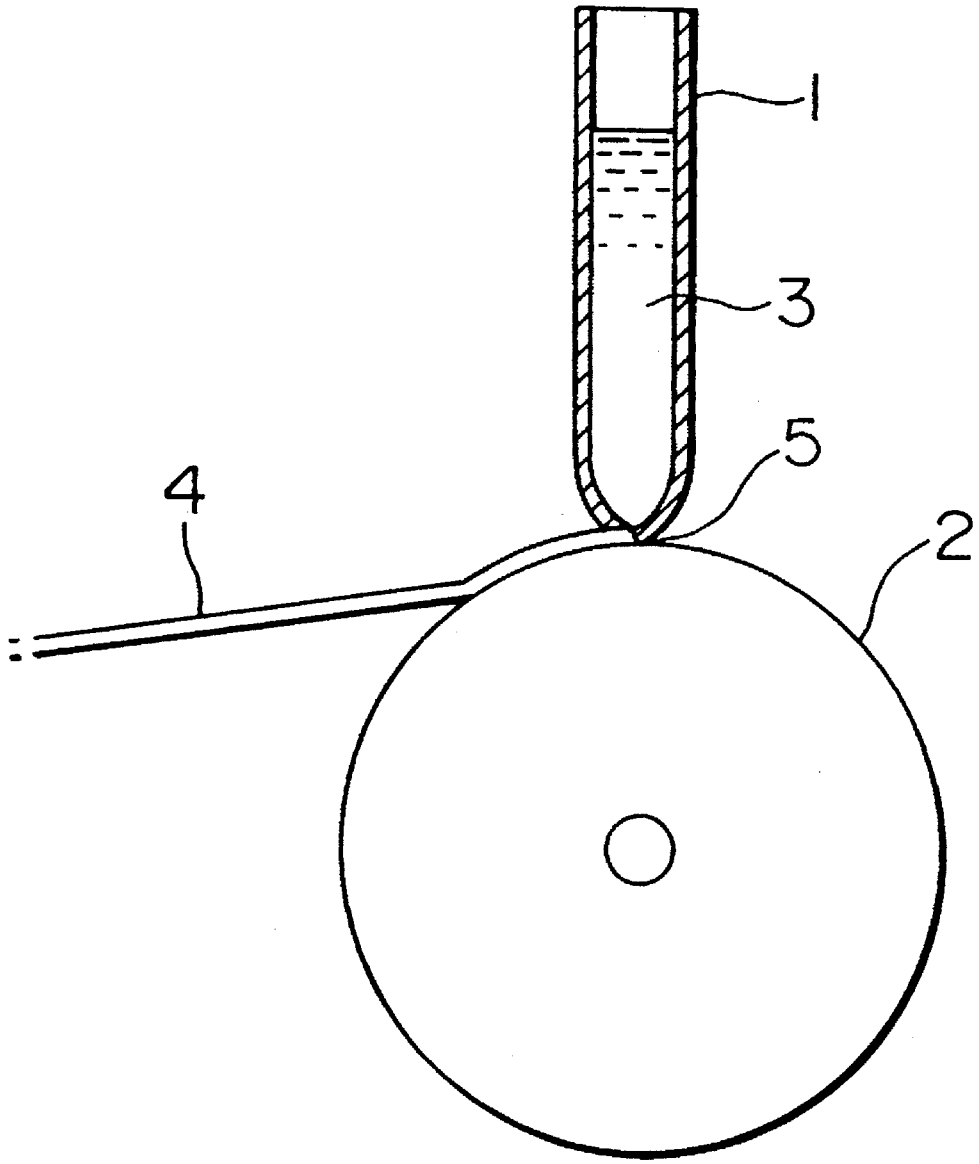
FIG. 1 shows a construction of an example of a single roll apparatus used at the time of manufacturing a tape of an alloy of the present invention following quench solidification.

A molten alloy having a predetermined composition $Al_xM_yR_z$ was manufactured using a high frequency melting furnace. As shown in FIG. 1, this melt was poured into a silica tube 1 with a small aperture 5 (aperture diameter: 0.2 to 0.5 mm) at the tip, and then heat dissolved, following which the aforementioned silica tube 1 was positioned directly above copper roll 2. This roll 2 was then rotated at a high speed of 4000 rpm, and argon gas pressure (0.7 kg/cm$^3$) was applied to silica tube 1. Quench solidification was subsequently performed by discharging the liquid-melt 3 from small aperture 5 of silica tube 1 onto the surface of roll 2 and quenching to yield an alloy tape 4.

Under these manufacturing conditions, the numerous alloy tape samples (width: 1 mm, thickness: 20 μm) of the compositions (atomic percentages) shown in Tables 1 and 2 were formed. Each sample was observed by both X-ray diffraction and TEM (transmission electron microscope).

These results, shown in the structural state column of Tables 1 and 2, confirmed that an amorphous single-phase structure, a crystalline structure formed from an intermetallic compound or solid solution, and a two-phase structure (fcc-Al+Amo) formed by dispersing fine crystal grains, modified from aluminum having an fcc structure, into the amorphous matrix layer, were obtained.

Subsequently, the hardness (Hv) and tensile rupture strength (σf: MPa) of each alloy tape sample were measured. These results are similarly shown in Tables 1 and 2. The hardness value (DPN: Diamond Pyramid Number) was measured according to the minute Vickers hardness scale.

Additionally, a 180° contact bending test was conducted by bending each sample 180° and contacting the ends thereby forming a U-shape.

The results of these tests are also shown in Tables 1 and 2: those samples which displayed ductility and did not rupture are designated Duc (ductile), while those which ruptured are designated Bri (brittle).

It is clear from the results shown in Tables 1 and 2 that an aluminum-based alloy possessing a high bearing force and hardness, which endured bending and could undergo processing, was obtainable when the atomic percentages satisfied the relationships of $64.5 \leqq Al \leqq 95$, $5 \leqq M \leqq 35$, and $0 < R \leqq 0.4$.

In contrast to normal aluminum-based alloys which possess an Hv of approximately 50 to 100 DPN, the samples according to the present invention, shown in Tables 1 and 2, display an extremely high hardness from 260 to 340 DPN.

In addition, in regards to the tensile rupture strength (σf), normal age hardened type aluminum-based alloys (Al—Si—Fe type) possess values from 200 to 600 MPa, however, the samples according to the present invention have clearly superior values in the range from 800 to 1250 MPa.

Furthermore, when considering that the tensile strengths of aluminum-based alloys of the AA6000 series (alloy name according to the Aluminum Association (U.S.A.)) and AA7000 series which lie in the range from 250 to 300 MPa, Fe-type structural steel sheets which possess a value of approximately 400 MPa, and high tensile strength steel sheets of Fe-type which range from 800 to 980 MPa, it is clear that the aluminum-based alloys according to the present invention display superior values.

Figure 2:
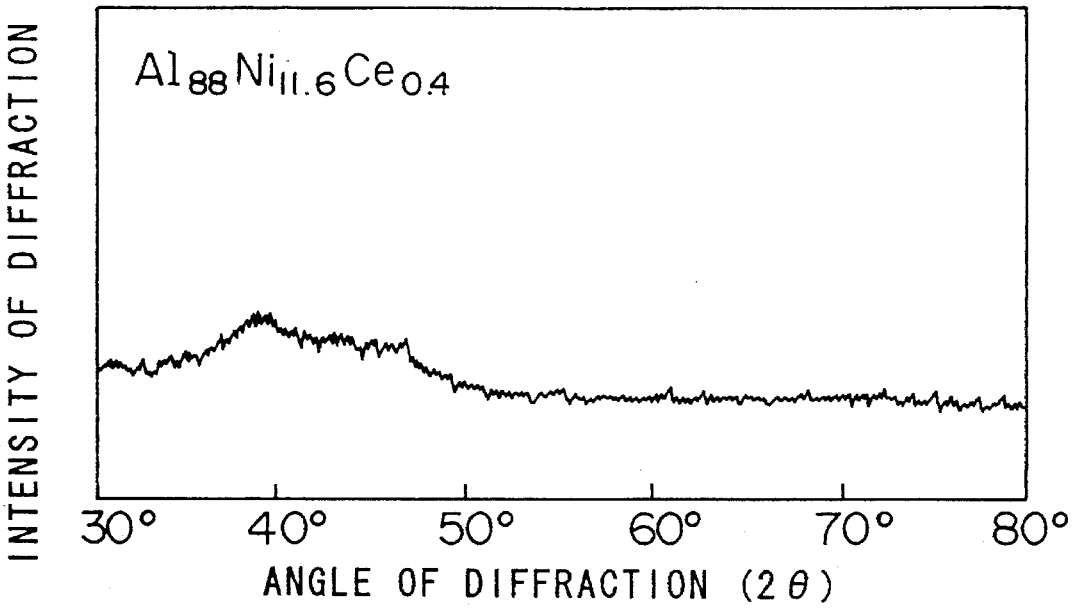
FIG. 2 shows the analysis result of the X-ray diffraction of an alloy having the composition of $Al_{88}Ni_{11.6}Ce_{0.4}$.

FIG. 2 shows the analysis result of the X-ray diffraction of an alloy having the composition of $Al_{88}Ni_{11.6}Ce_{0.4}$. In this FIG., the crystal peak (not discernible) appears as a broad peak pattern with the alloy sample displaying an amorphous single phase structure.

Figure 3:
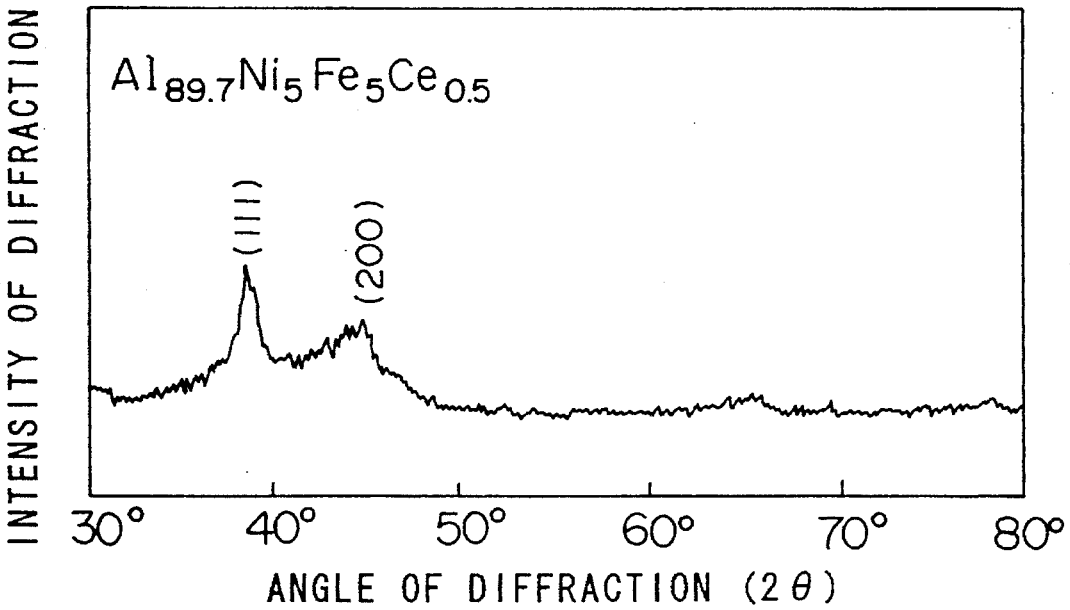
FIG. 3 shows the analysis result of the X-ray diffraction of an alloy having the composition of $Al_{89.7}Ni_5Fe_5Ce_{0.3}$.

FIG. 3 shows the analysis result of the X-ray diffraction of an alloy having the composition of $Al_{89.7}Ni_5Fe_5Ce_{0.3}$. In this FIG., a two-phase structure is displayed in which fine Al particles having an fcc structure of the nano-scale are dispersed into the amorphous phase. In the FIG., (111) and (200) display the crystal peaks of Al having an fcc structure.

Figure 4:
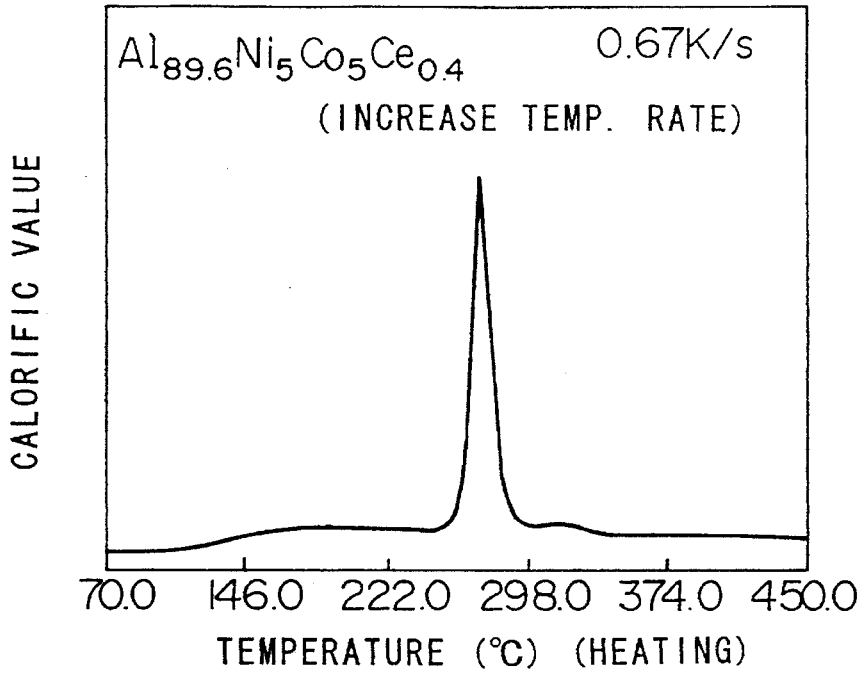
FIG. 4 shows the thermal properties of an alloy having the composition of $Al_{89.6}Ni_5Co_5Ce_{0.4}$.

FIG. 4 shows the DSC (Differential Scanning Calorimetry) curve in the case when an alloy having the composition of $Al_{89.6}Ni_5Co_5Ce_{0.4}$ is heated at an increase temperature rate of 0.67 K/s.

Figure 5:
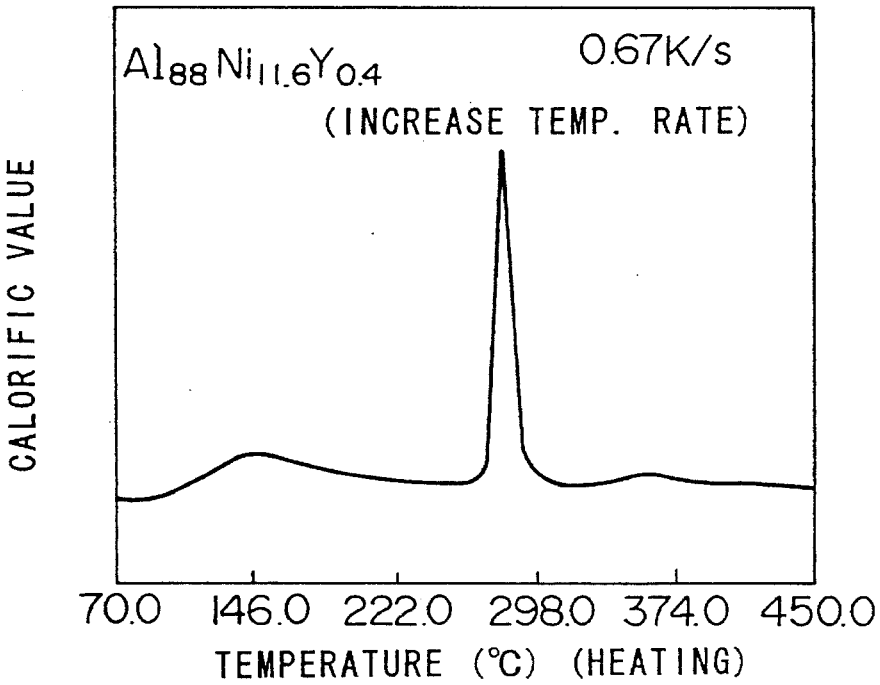
FIG. 5 shows the thermal properties of an alloy having the composition of $Al_{88}Ni_{11.6}Y_{0.4}$.

FIG. 5 shows the DSC curve in the case when an alloy having the composition of $Al_{88}Ni_{11.6}Y_{0.4}$ is heated at an increase temperature rate of $_{0.67}$ K/s.

As is clear from FIGS. 4 and 5, the broad peak appearing at lower temperatures represents the crystallization peak of Al particles having an fcc structure, while the sharp peak at higher temperatures represents the crystallization peak of the alloys. Due to the existence of these two peaks, when performing heat treatment such as quench hardening at an appropriate temperature, the volume percentage of the Al particles dispersed into the amorphous matrix phase can be controlled. As a result, it is clear that the mechanical properties can be improved through heat treatment.

In addition, in order to show criticality of the aforementioned composition ratios of $64.5 \leqq Al \leqq 95$, $5 \leqq M \leqq 35$, and $0 < R \leqq 0.4$, FIGS. 6–14 are provided.

Figure 6:
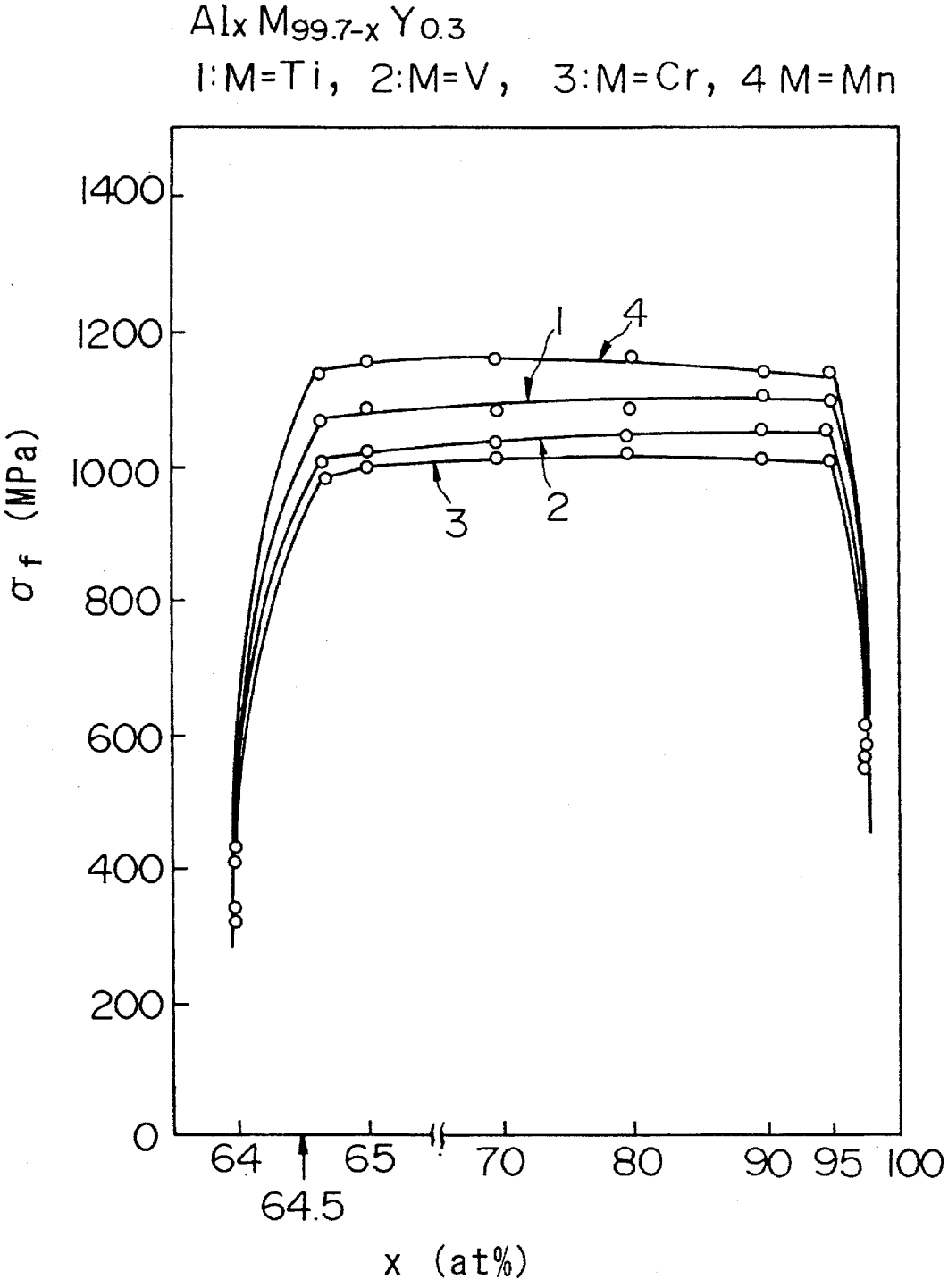
FIG. 6 is a graph showing variation of the tensile rupture strength of alloys having the compositions of $Al_xM_{99.7-x}Y_{0.3}$ corresponding to various values of x.

The graph in FIG. 6 shows variation of the tensile rupture strength (σf) of alloys having the compositions of $Al_x M_{99.7-x} Y_{0.3}$ (in which element M is Ti, V, Cr, or Mn) corresponding to various values of x.

Figure 7:
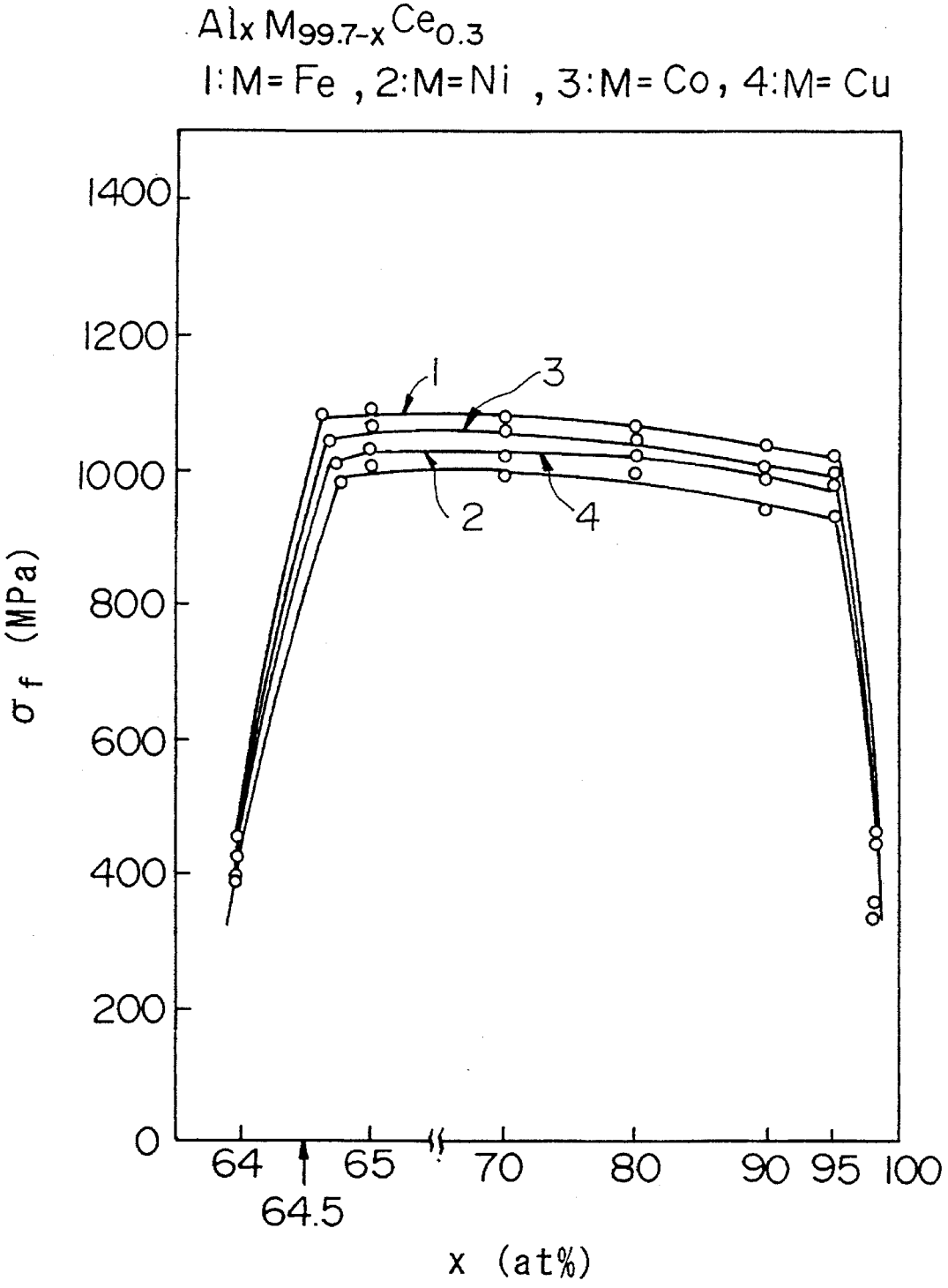
FIG. 7 is a graph showing variation of the tensile rupture strength of alloys having the compositions of $Al_x M_{99.7-x} Ce_{0.3}$ corresponding to various values of x.

The graph in FIG. 7 shows variation of the tensile rupture strength (σf) of alloys having the compositions of $Al_x M_{99.7-x} Ce_{0.3}$ (in which element M is Fe, Ni, Co, or Cu) corresponding to various values of x.

Figure 8:
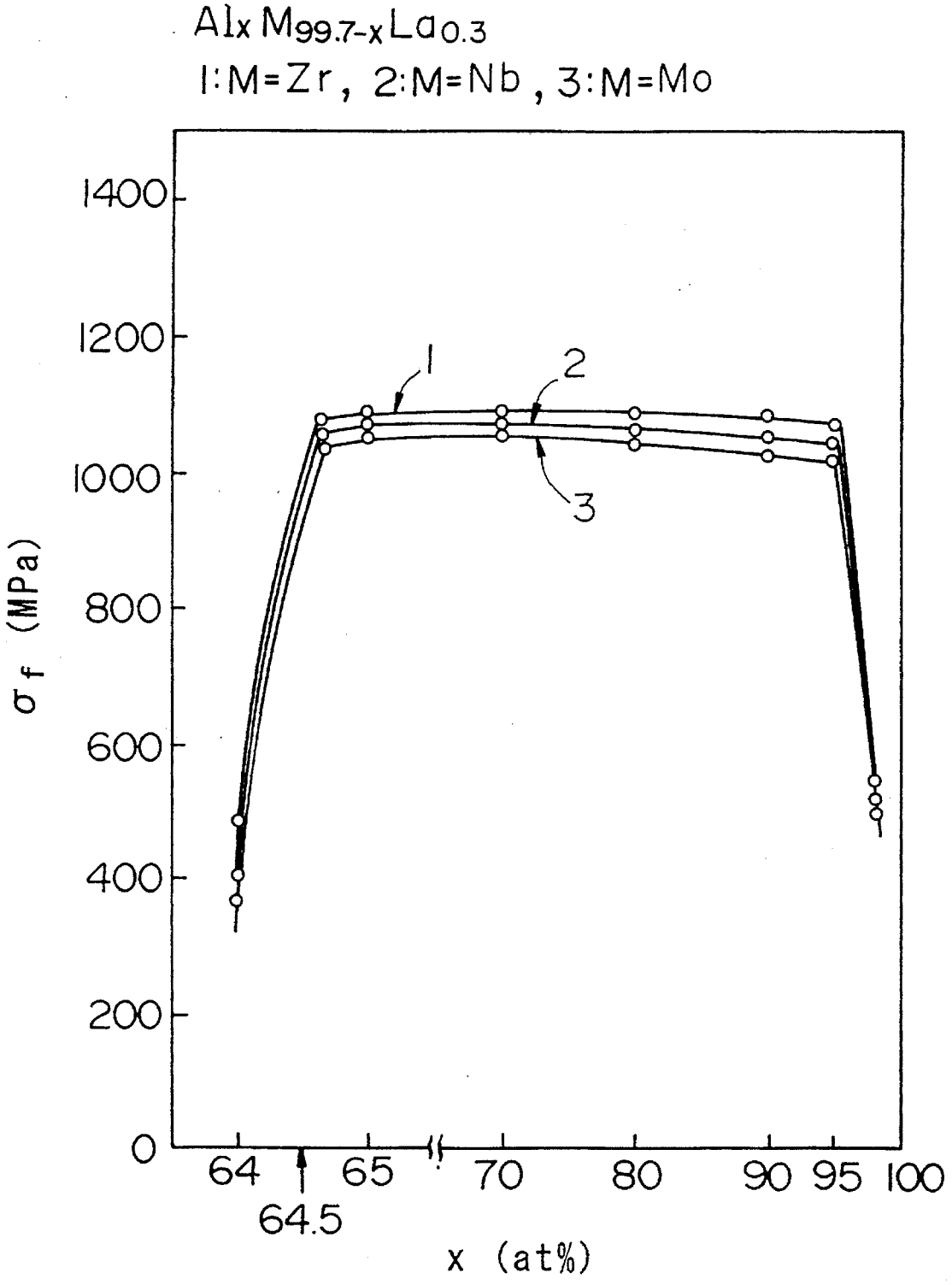
FIG. 8 is a graph showing variation of the tensile rupture strength of alloys having the compositions of $Al_x M_{99.7-x}La_{0.3}$ corresponding to various values of x.

The graph in FIG. 8 shows variation of the tensile rupture strength (σf) of alloys having the compositions of $Al_x M_{99.7-x} La_{0.3}$ (in which element M is Zr, Nb, or Mo) corresponding to various values of x.

According to the graphs of FIGS. 6–8, it can be seen that an alloy having a composition of $Al_xM_yR_z$ in which the atomic percentage for Al is less than 64.5% or exceeds 95% is undesirable, since such an alloy may not have sufficient strength.

Figure 9:
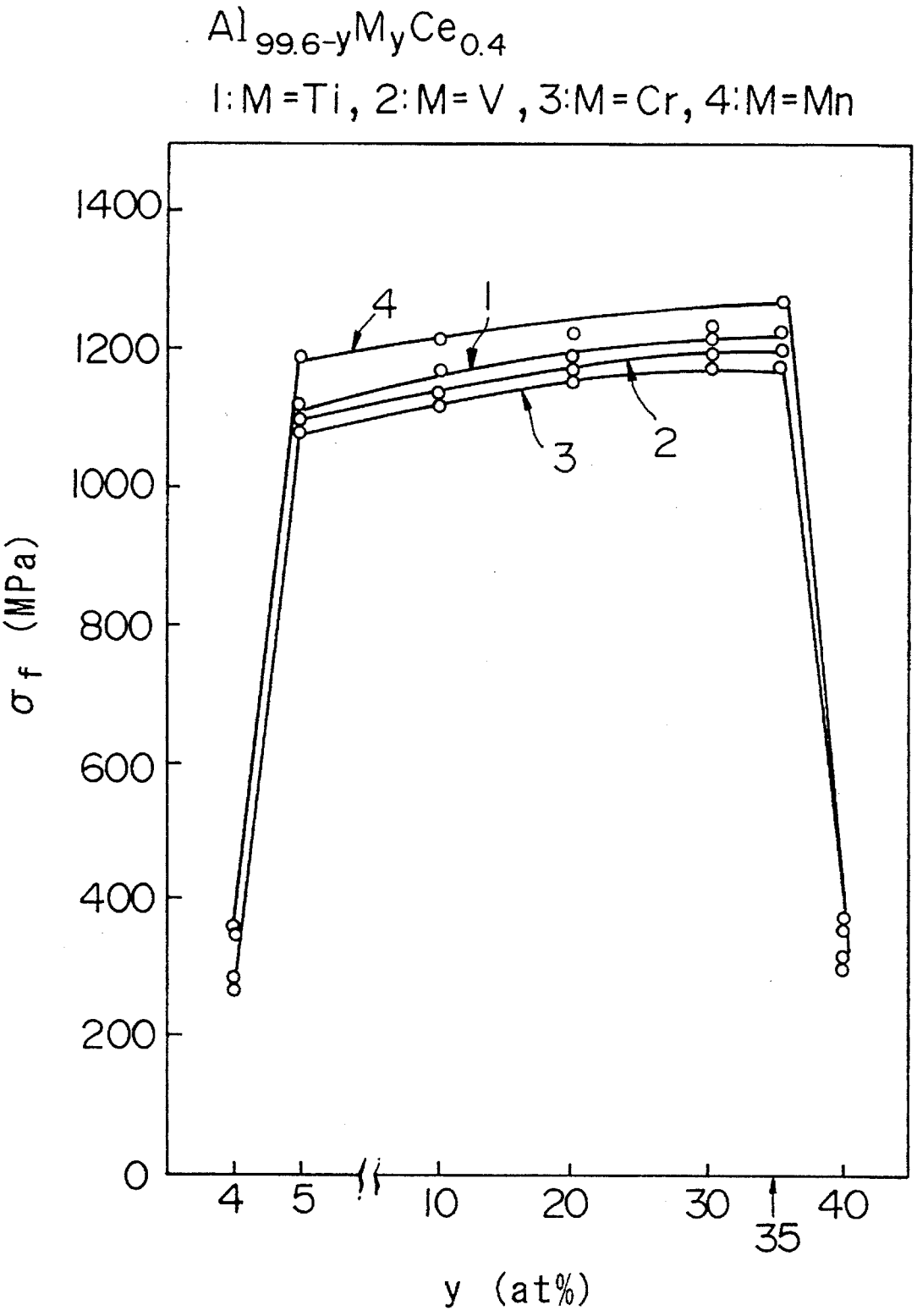
FIG. 9 is a graph showing variation of the tensile rupture strength of alloys having the compositions of $Al_{99.6-y} M_yCe_{0.4}$ corresponding to various values of y.

The graph in FIG. 9 shows variation of the tensile rupture strength (σf) of alloys having the compositions of $Al_{99.6-y} M_y Ce_{0.4}$ (in which element M is Ti, V, Cr, or Mn) corresponding to various values of y.

Figure 10:
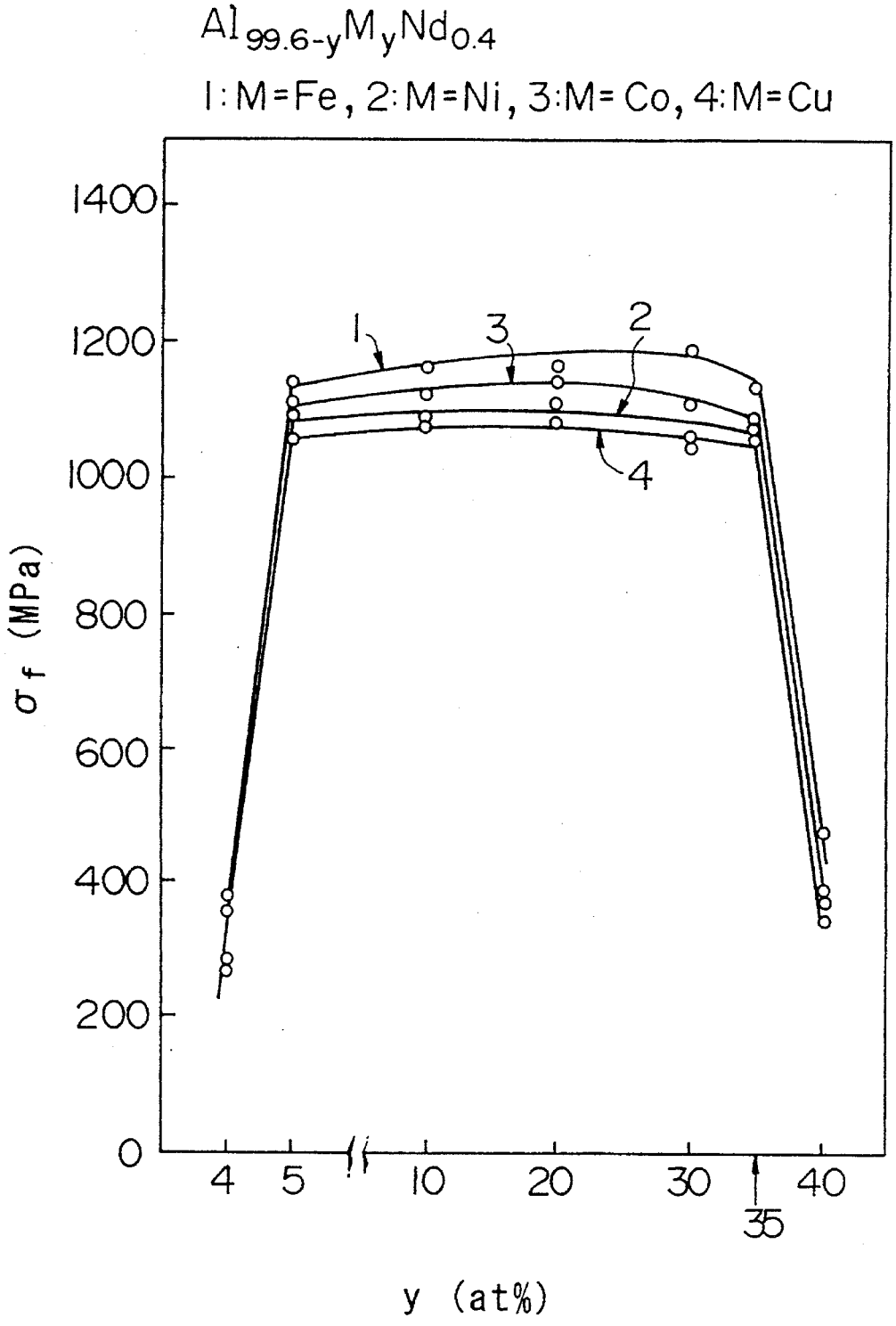
FIG. 10 is a graph showing variation of the tensile rupture strength of alloys having the compositions of $Al_{99.6-y} M_yNd_{0.4}$ corresponding to various values of y.

The graph in FIG. 10 shows variation of the tensile rupture strength (σf) of alloys having the compositions of $Al_{99.6-y}M_yNd_{0.4}$ (in which element M is Fe, Ni, Co, or Cu) corresponding to various values of y.

Figure 11:
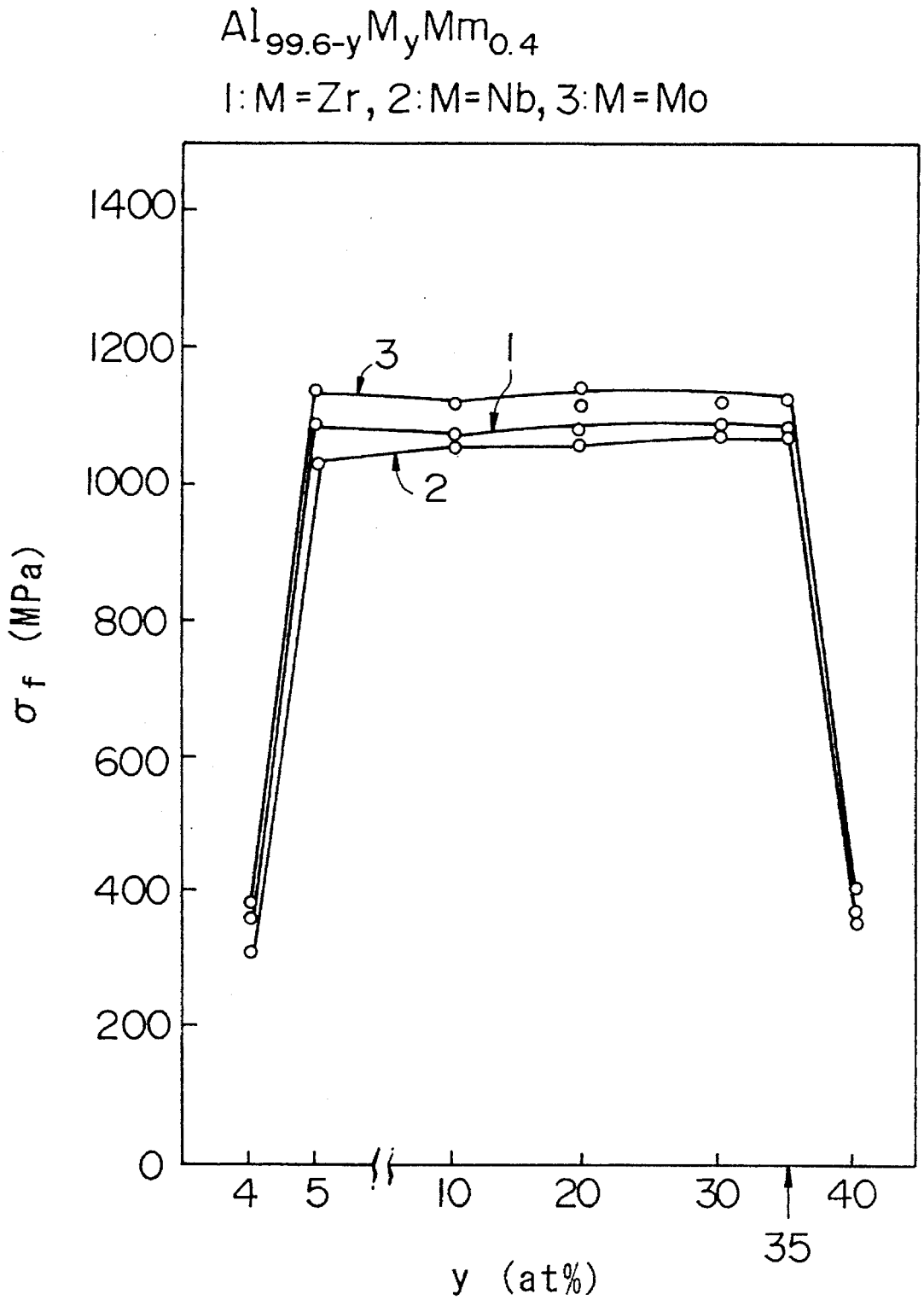
FIG. 11 is a graph showing variation of the tensile rupture strength of alloys having the compositions of $Al_{99.6-y} M_yMm_{0.4}$ corresponding to various values of y.

The graph in FIG. 11 shows variation of the tensile rupture strength (σf) of alloys having the compositions of $Al_{99.6-y}M_yMm_{0.4}$ (in which element M is Zr, Nb, or Mo) corresponding to various values of y.

According to the graphs of FIGS. 9–11, it can be seen that an alloy having a composition of $Al_xM_yR_z$ in which the atomic percentage for element M is less than 5% or exceeds 35% is undesirable, since such an alloy may not have sufficient strength.

Figure 12:
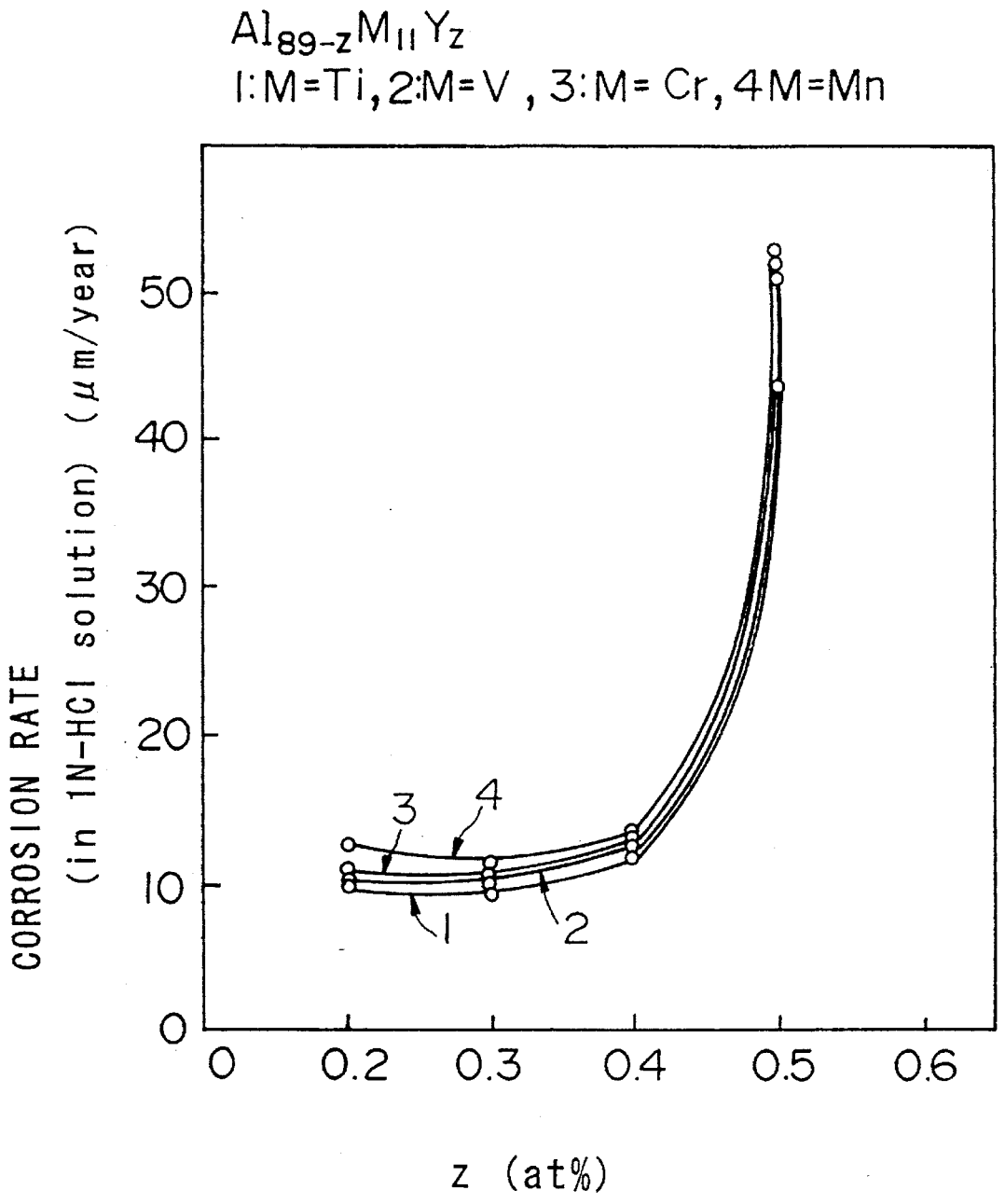
FIG. 12 is a graph showing variation of the corrosion rate of alloys having the compositions of $Al_{89-z}M_{11}Y_z$ corresponding to various values of z.

The graph in FIG. 12 shows variation of the corrosion rate (in 1N-HCl solution) of alloys having the compositions of $Al_{89-z}M_{11}Y_z$ (in which element M is Ti, V, Cr, or Mn) corresponding to various values of z.

Figure 13:
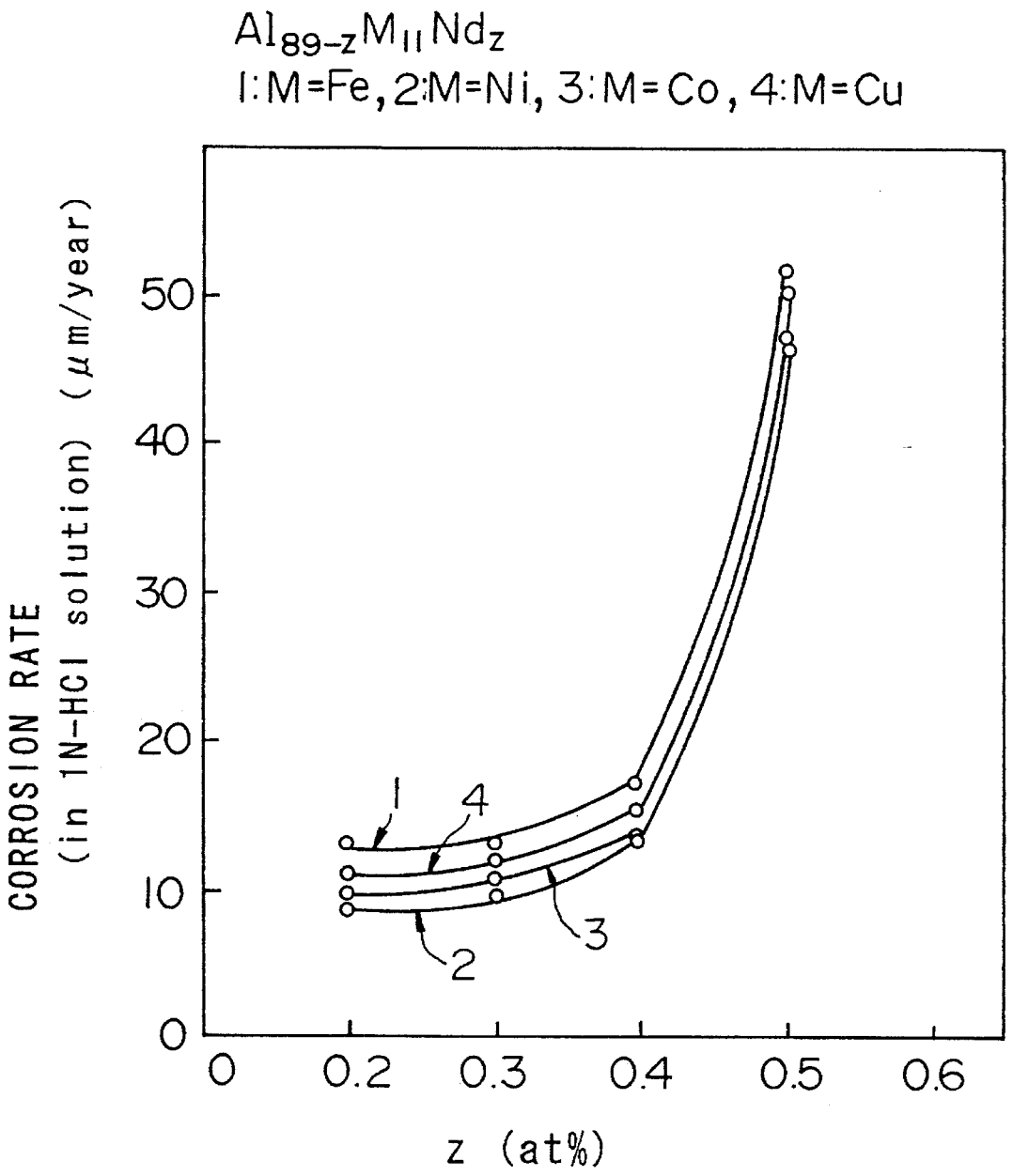
FIG. 13 is a graph showing variation of the corrosion rate of alloys having the compositions of $Al_{89-z}M_{11}Nd_z$ corresponding to various values of z.

The graph in FIG. 13 shows variation of the corrosion rate (in 1N-HCl solution) of alloys having the compositions of $Al_{89-z}M_{11}Nd_z$ (in which element M is Fe, Ni, Co, or Cu) corresponding to various values of z.

Figure 14:
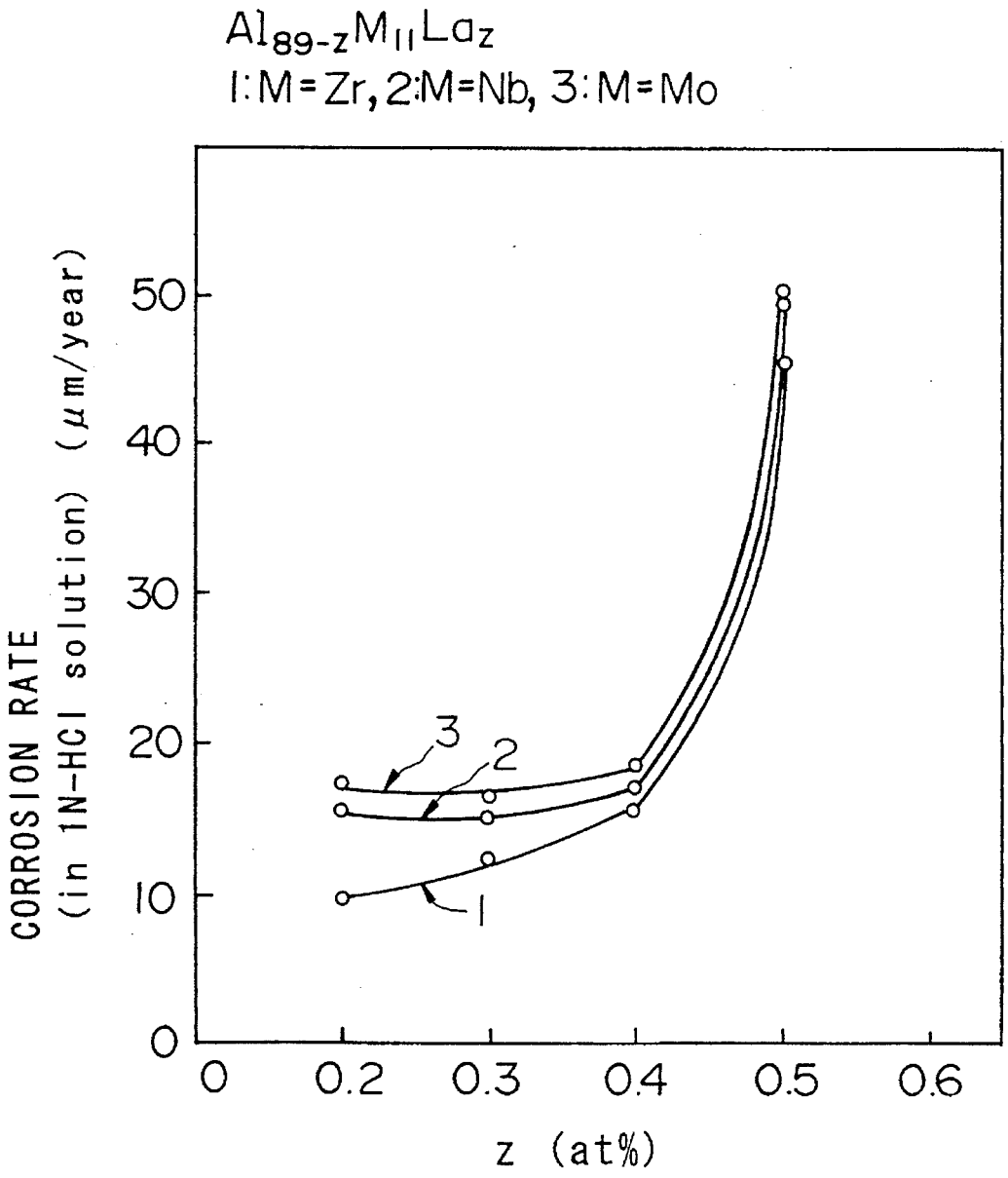
FIG. 14 is a graph showing variation of the corrosion rate of alloys having the compositions of $Al_{89-z}M_{11}La_z$ corresponding to various values of z.

The graph in FIG. 14 shows variation of the corrosion rate (in 1N-HCl solution) of alloys having the compositions of $Al_{89-z}M_{11}La_z$ (in which element M is Zr, Nb, or corresponding to various values of z.

According to the graphs of FIGS. 12–14, it can be seen that an alloy having a composition of $Al_xM_yR_z$ in which the atomic percentage for element R exceeds 0.4% is undesirable, since such an alloy may corrode easily.

[Second Preferred Embodiment]

In a manner similar to the first preferred embodiment, a molten alloy having a predetermined composition $Al_xNi_yM'_z$ was manufactured using a high frequency melting furnace. As shown in FIG. 1, this melt was poured into a silica tube 1 with a small aperture 5 (aperture diameter: 0.2 to 0.5 mm) at the tip, and then heat dissolved, following which the aforementioned silica tube 1 was positioned directly above copper roll 2. This roll 2 was then rotated at a high speed of 4000 rpm, and argon gas pressure (0.7kg/cm$^3$) was applied to silica tube 1. Quench solidification was subsequently performed by discharging the liquid-melt from small aperture 5 of silica tube 1 onto the surface of roll 2 and quenching to yield an alloy tape 4.

Under these manufacturing conditions, the numerous alloy tape samples (width: 1 mm, thickness: 20 μm) of the compositions (atomic percentages) shown in Tables 3 and 4 were formed. Each sample was observed by both X-ray analysis and TEM (transmission electron microscope).

These results, shown in the structural state column of Tables 3 and 4, confirmed that an amorphous single-phase structure, a crystalline structure formed from an intermetallic compound or solid solution, and a two-phase structure (fcc-Al+Amo) formed by dispersing fine crystal grains, modified from aluminum having an fcc structure, into the amorphous matrix layer, were obtained.

Subsequently, the hardness (Hv) and tensile rupture strength (σf: MPa) of each alloy tape sample were measured. These results are similarly shown in Tables 3 and 4. The hardness value (DPN: Diamond Pyramid Number) was measured according to the minute Vickers hardness scale.

Additionally, the 180° contact bending test was conducted by bending each alloy tape sample 180° and contacting the ends thereby forming a U-shape.

The results of these tests are also shown in Tables 3 and 4: those samples which displayed ductility and did not rupture are designated Duc (ductile), while those which ruptured are designated Bri (brittle).

It is clear from the results shown in Tables 3 and 4 that an aluminum-based alloy possessing a high bearing force and hardness, which endured bending and could undergo processing, was obtainable when the atomic percentages satisfied the relationships of $50 \leqq Al \leqq 95$, $0.5 \leqq Ni \leqq 35$, and $0.5 \leqq M' \leqq 20$.

In contrast to normal aluminum-based alloys which possess an Hv of approximately 50 to 100 DPN, the samples according to the present invention shown in Tables 3 and 4 display an extremely high hardness ranging from 260 to 400 DPN.

In addition, in regards to the tensile rupture strength (σf), normal age hardened type aluminum-based alloys (Al—Si—Fe type) possess values from 200 to 600 MPa, however, the samples according to the present invention have clearly superior values in the range from 780 to 1150 MPa.

Furthermore, when considering that the tensile strengths of aluminum-based alloys of the AA6000 series and AA7000 series which lie in the range from 250 to 300 MPa, Fe-type structural steel sheets which possess a value of approximately 400 MPa, and high tensile strength steel sheets of Fe-type which range from 800 to 980 MPa, it is clear that the aluminum-based alloys according to the present invention display superior values.

Figure 15:
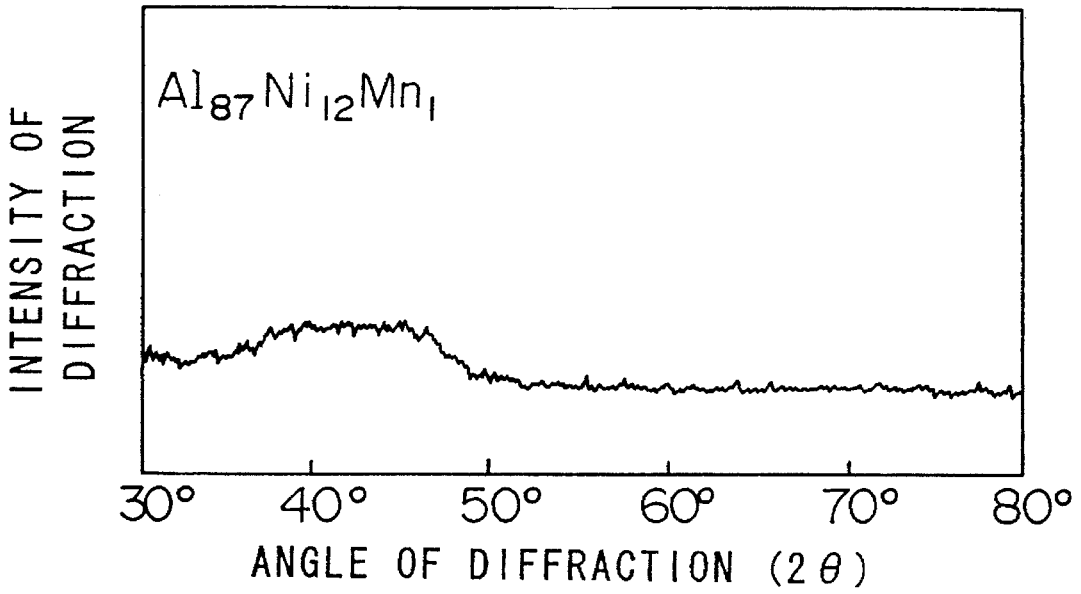
FIG. 15 shows the analysis result of the X-ray diffraction of an alloy having the composition of $Al_{87}Ni_{12}Mn_1$.

FIG. 15 shows the analysis result of the X-ray diffraction of an alloy having the composition of $Al_{87}Ni_{12}Mn_1$. In this FIG., the crystal peak (not discernible) appears as a broad peak pattern with the alloy sample displaying an amorphous single phase structure.

Figure 16:
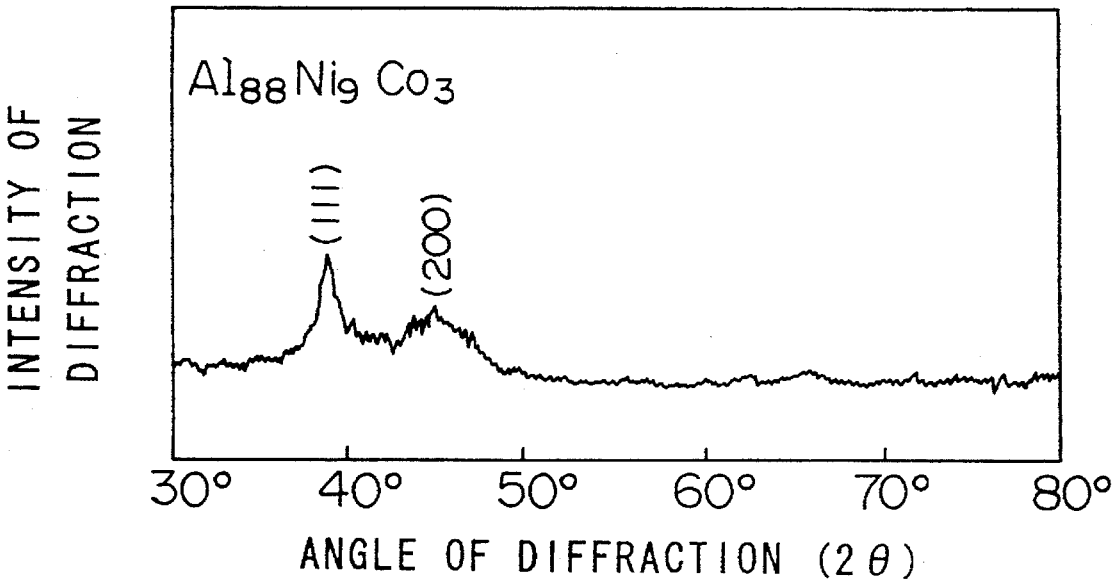
FIG. 16 shows the analysis result of the X-ray diffraction of an alloy having the composition of $Al_{88}Ni_9Co_3$.

FIG. 16 shows the analysis result of the X-ray diffraction of an alloy having the composition of $Al_{88}Ni_9Co_3$. In this FIG., a two-phase structure is displayed in which fine Al particles having an fcc structure of the nano-scale are dispersed into the amorphous phase. In the FIG., (111) and (200) display the crystal peaks of Al having an fcc structure.

Figure 17:
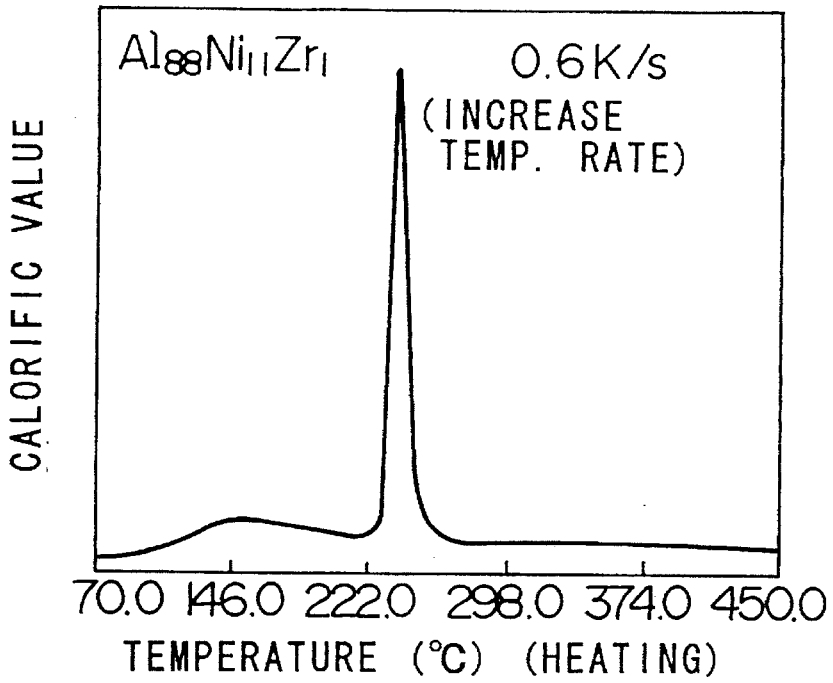
FIG. 17 shows the thermal properties of an alloy having the composition of $Al_{88}Ni_{11}Zr_1$.

FIG. 17 shows the DSC (Differential Scanning Calorimetry) curve in the case when an alloy having the composition of $Al88Ni_{11}Zr_1$ is heated at an increase temperature rate of 0.67 K/s.

Figure 18:
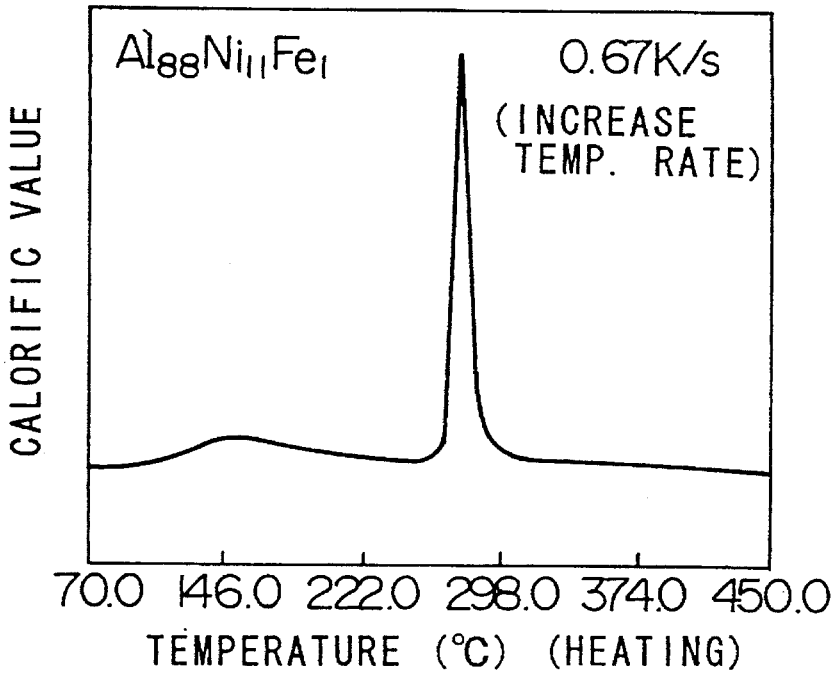
FIG. 18 shows the thermal properties of an alloy having the composition of $Al_{88}Ni_{11}Fe_1$.

FIG. 18 shows the DSC curve in the case when an alloy having the composition of $Al_{88}Ni_{11}Fe_1$ is heated at an increase temperature rate of 0.67 K/s.

As is clear from FIGS. 17 and 18, the broad peak appearing at lower temperatures represents the crystallization peak of Al particles having an fcc structure, while the sharp peak at higher temperatures represents the crystallization peak of the alloys. Due to the existence of these two peaks, when performing heat treatment such as quench hardening at an appropriate temperature, the volume percentage of the Al particles dispersed into the amorphous matrix phase can be controlled. As a result, it is clear that the mechanical properties can be improved through heat treatment.

In addition, in order to show criticality of the aforementioned composition ratios of $50 \leqq Al \leqq 95$, $0.5 \leqq Ni \leqq 35$, and $0.5 \leqq M' \leqq 20$, FIGS. 19–24 are provided.

Figure 19:
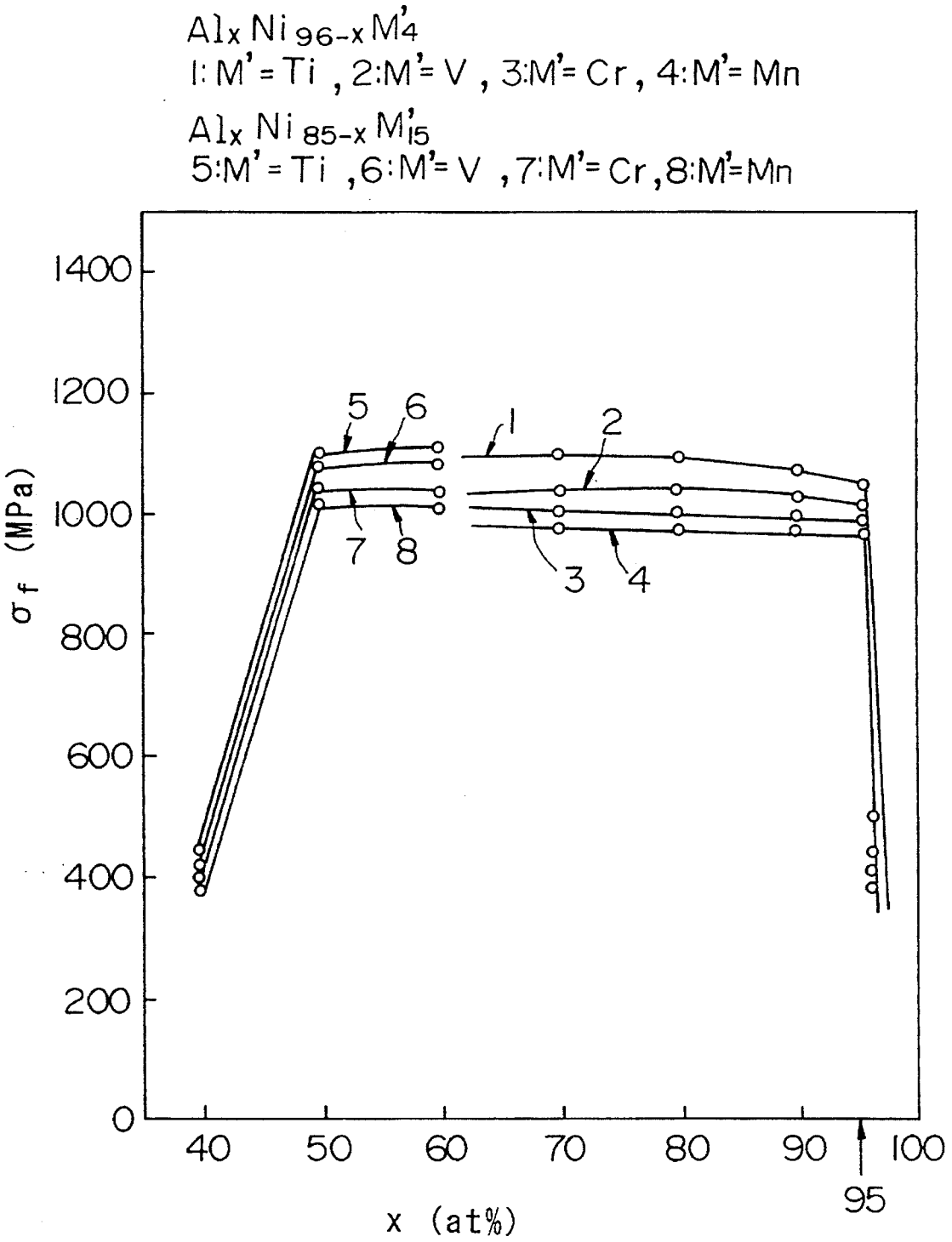
FIG. 19 is a graph showing variation of the tensile rupture strength of alloys having the compositions of $Al_xNi_{96-x}M'_4$ and $Al_xNi_{85-x}M'_{15}$ corresponding to various values of x.

The graph in FIG. 19 shows variation of the tensile rupture strength (σf) of alloys having the compositions of $Al_xNi_{96-x}M'_4$ and $Al_xNi_{85-x}M'_{15}$ (in which element M' is Ti, V, Cr, or Mn) corresponding to various values of x.

Figure 20:
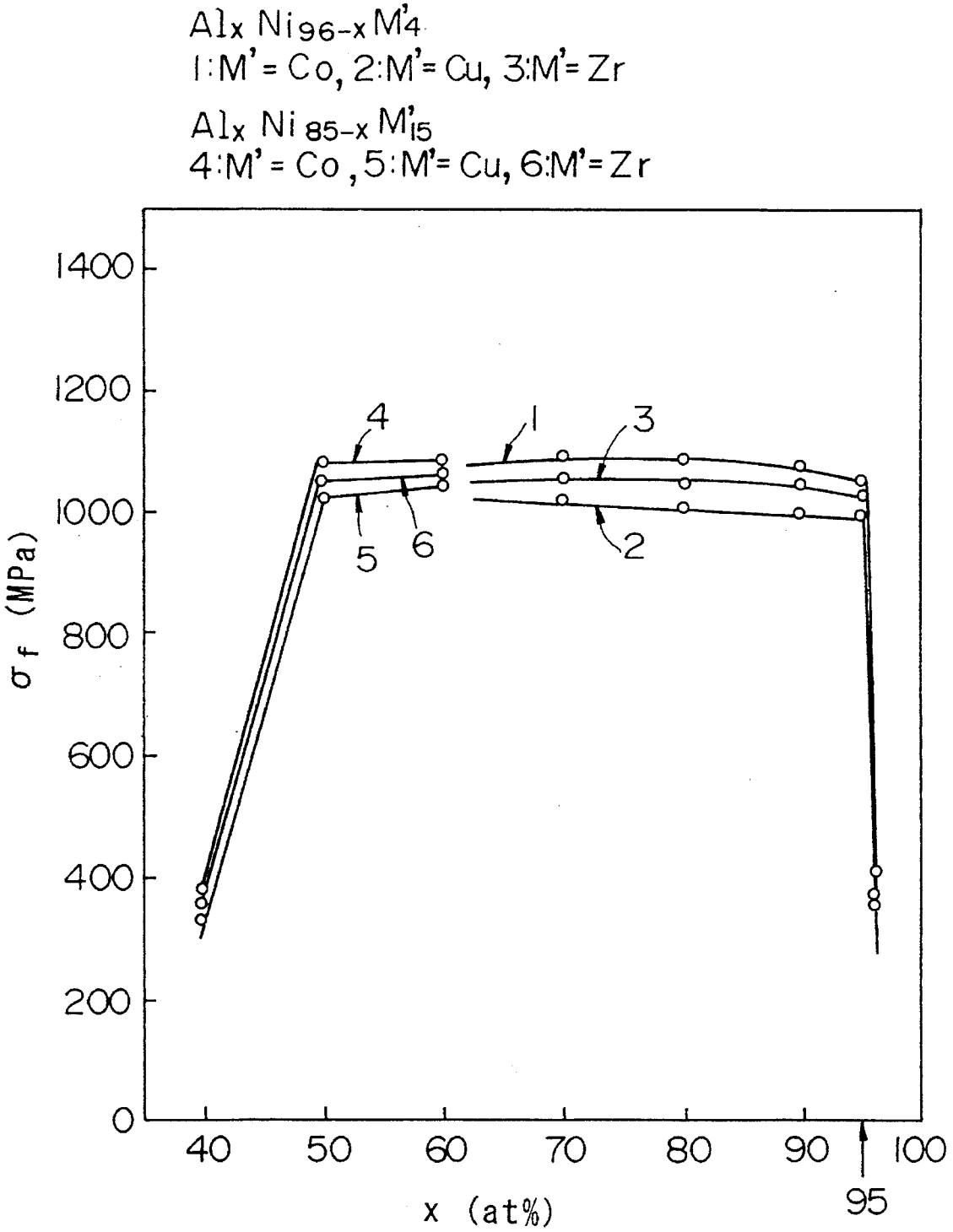
FIG. 20 is a graph showing variation of the tensile rupture strength of alloys having the compositions of $Al_xNi_{96-x}M'_4$ and $Al_xNi_{85-x}M'_{15}$ corresponding to various values of x.

The graph in FIG. 20 shows variation of the tensile rupture strength (σf) of alloys having the compositions of $Al_xNi_{96-x}M'_4$ and $Al_xNi_{85-x}M'_{15}$ (in which element M' is Co, Cu, or Zr) corresponding to various values of x.

According to the graphs of FIGS. 19 and 20, it can be seen that an alloy having a composition of $Al_xNi_yM'_z$ in which the atomic percentage for Al is less than 50% or exceeds 95% is undesirable, since such an alloy may not have sufficient strength.

Figure 21:
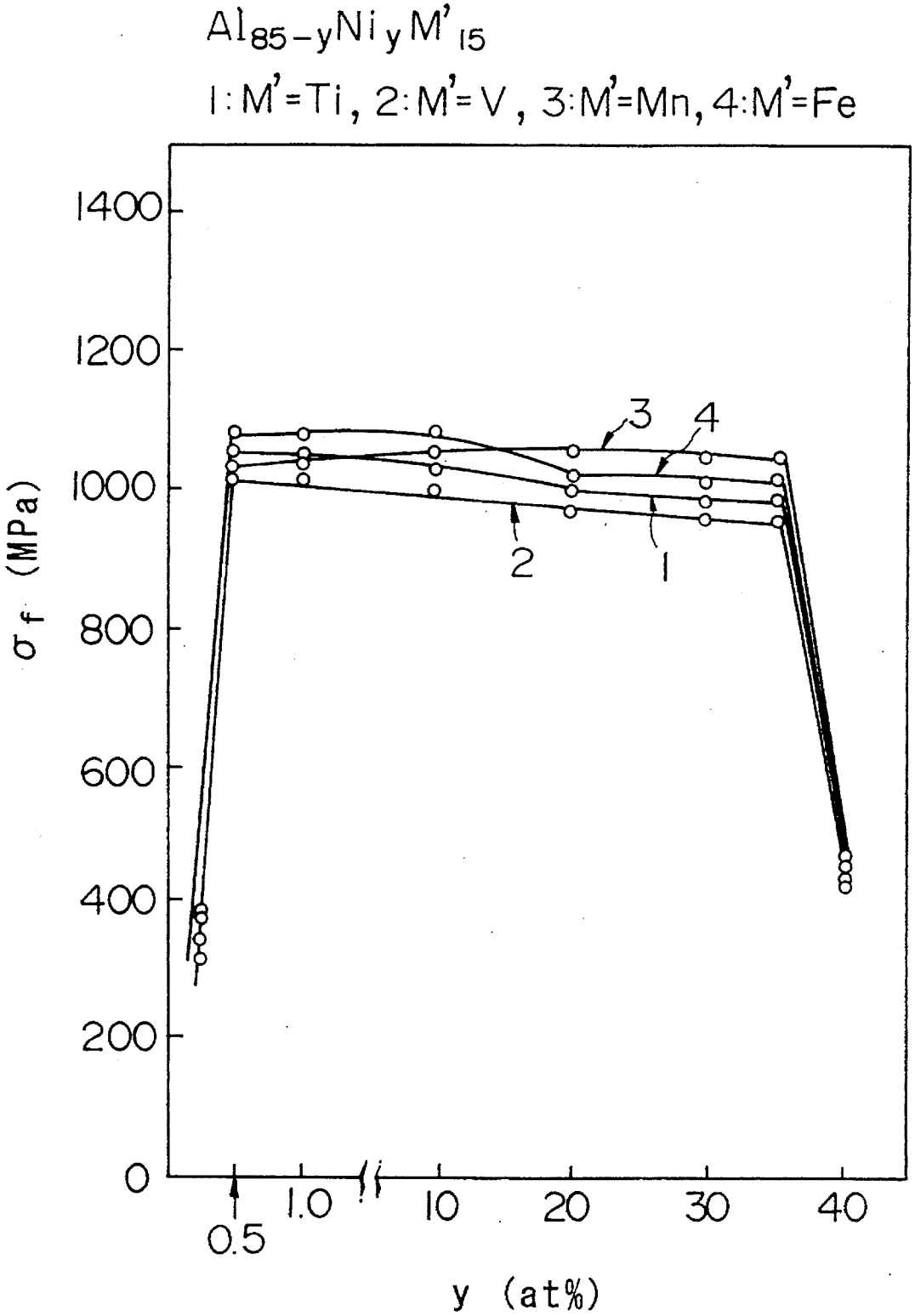
FIG. 21 is a graph showing variation of the tensile rupture strength of alloys having the compositions of $Al_{85-y}Ni_yM'_{15}$ corresponding to various values of y.

The graph in FIG. 21 shows variation of the tensile rupture strength (σf) of alloys having the compositions of $Al_{85-y}Ni_yM'_{15}$ (in which element M' is Ti, V, Mn, or Fe) corresponding to various values of y.

Figure 22:
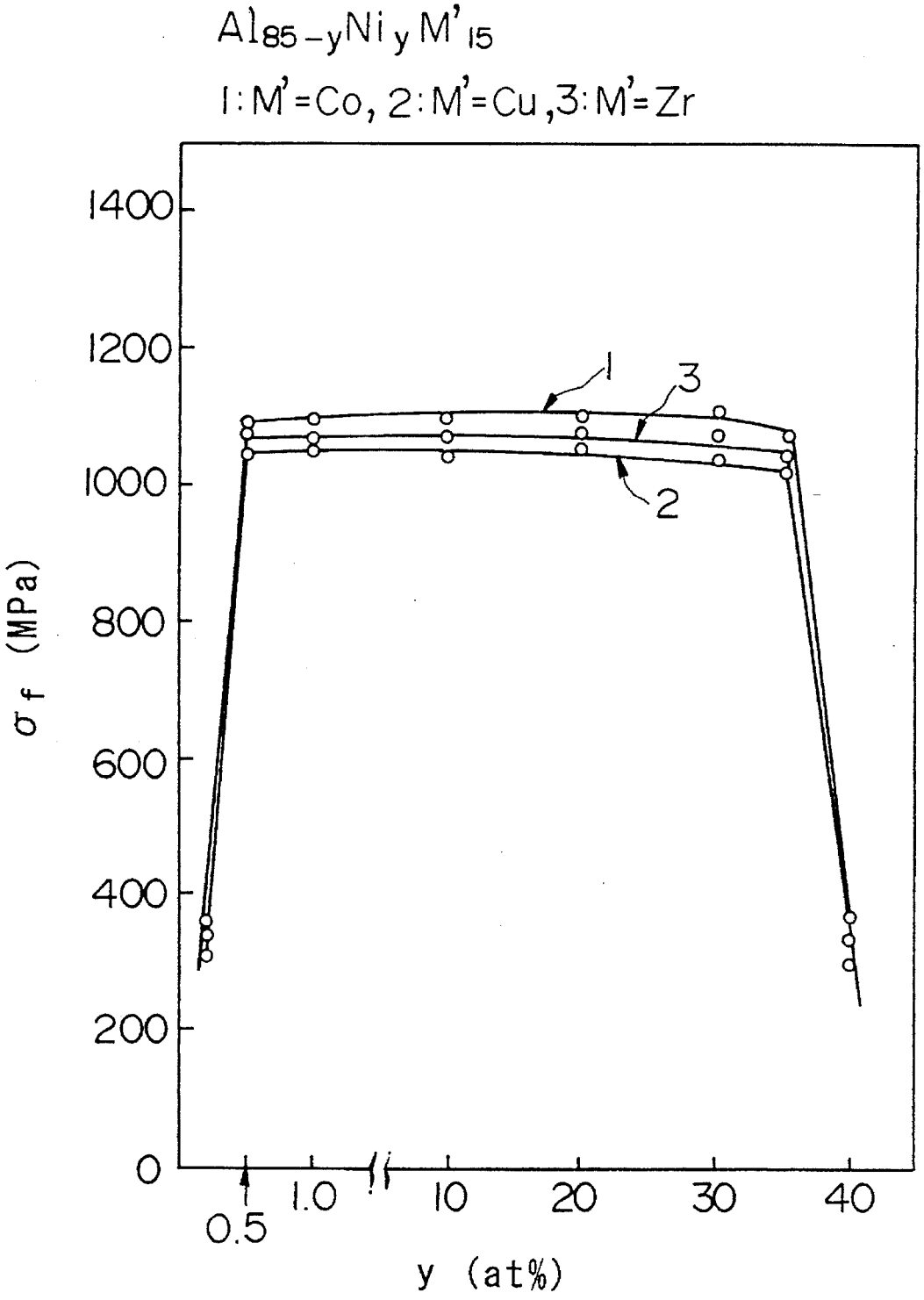
FIG. 22 is a graph showing variation of the tensile rupture strength of alloys having the compositions of $Al_{85-y}Ni_yM'_{15}$ corresponding to various values of y.

The graph in FIG. 22 shows variation of the tensile rupture strength (σf) of alloys having the compositions of $Al_{85-y}Ni_yM'_{15}$ (in which element M' is Co, Cu, or Zr) corresponding to various values of y.

According to the graphs of FIGS. 21 and 22, it can be seen that an alloy having a composition of $Al_xNi_yM'_z$ in which the atomic percentage for Ni is less than 0.5% or exceeds 35% is undesirable, since such an alloy may not have sufficient strength.

Figure 23:
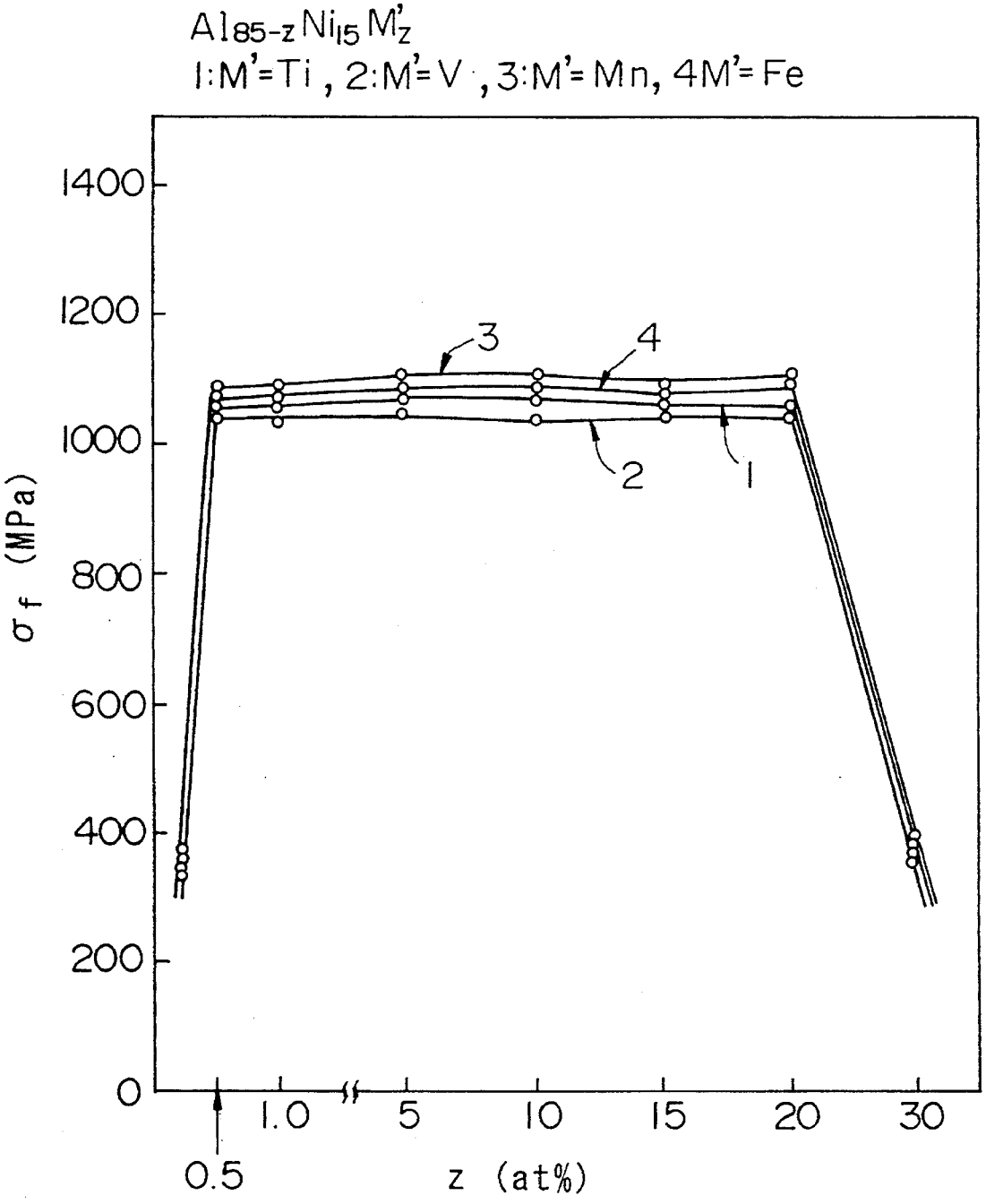
FIG. 23 is a graph showing variation of the tensile rupture strength of alloys having the compositions of $Al_{85-z}Ni_{15}M'_z$ corresponding to various values of z.

The graph in FIG. 23 shows variation of the tensile rupture strength (σf) of alloys having the compositions of $Al_{85-z}Ni_{15}M'_z$ (in which element M' is Ti, V, Mn, or Fe) corresponding to various values of z.

Figure 24:
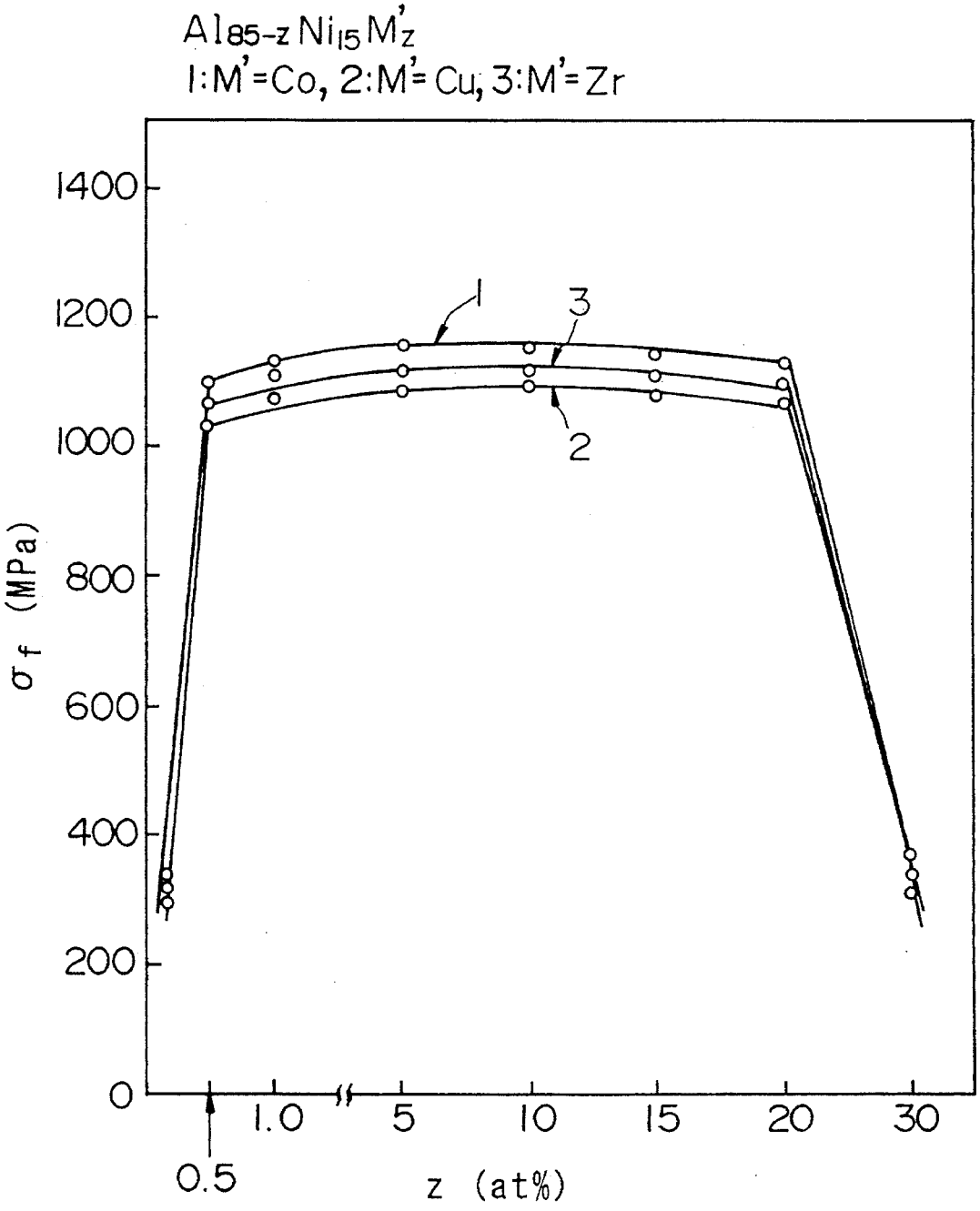
FIG. 24 is a graph showing variation of the tensile rupture strength of alloys having the compositions of $Al_{85-z}Ni_{15}M'_z$ corresponding to various values of z.

The graph in FIG. 24 shows variation of the tensile rupture strength (σf) of alloys having the compositions of $Al_{85-z}Ni_{15}M'_z$ (in which element M' is Co, Cu, or Zr) corresponding to various values of z.

According to the graphs of FIGS. 23 and 24, it can be seen that an alloy having a composition of $Al_xNi_yM'_z$ in which the atomic percentage for element M' is less than 0.5% or exceeds 20% is undesirable, since such an alloy may not have sufficient strength.

[Third Preferred Embodiment]

In a manner similar to the first and second preferred embodiments, a molten alloy having a predetermined composition $Al_xCo_yM''_z$ or $Al_aFe_bL_c$ was manufactured using a high frequency melting furnace. As shown in FIG. 1, this melt was poured into a silica tube 1 with a small aperture 5 (aperture diameter: 0.2 to 0.5 mm) at the tip, and then heat dissolved, following which the aforementioned silica tube 1 was positioned directly above copper roll 2. This roll 2 was then rotated at a high speed of 4000 rpm, and argon gas pressure (0.7kg/cm$^3$) was applied to silica tube 1. Quench solidification was subsequently performed by discharging the liquid-melt from small aperture 5 of silica tube 1 onto the surface of roll 2 and quenching to yield an alloy tape 4.

Under these manufacturing conditions, the numerous alloy tape samples (width: 1 mm, thickness: 20 μm) of the compositions (atomic percentages) shown in Tables 5 to 7 were formed. Each sample was observed by both X-ray diffraction and TEM (transmission electron microscope).

These results, shown in the structural state column of Tables 5 to 7, confirmed that an amorphous (Amo) single-phase structure, a crystalline structure (Com) formed from an intermetallic compound or solid solution, a multiphase structure (fcc-Al+Amo) formed from fine crystal grains of aluminum having an fcc structure, and a structure formed from the aforementioned amorphous and crystalline structures, were obtained.

Subsequently, the hardness (Hv) and tensile rupture strength (σf: MPa) of each alloy tape sample were measured. These results are similarly shown in Tables 5 to 7. The hardness value (DPN: Diamond Pyramid Number) was measured according to the minute Vickers hardness scale.

Additionally, the 180° contact bending test was conducted by bending each sample 180° and contacting the ends thereby forming a U-shape. The results of these tests are also shown in Tables 5 to 7: those samples which displayed ductility and did not rupture are designated Duc (ductile), while those which did rupture are designated Bri (brittle) .

It is clear from the results shown in Tables 5 to 7 that when element M" is added to a Al—$Co_2$—component alloy, wherein M" is one or more elements selected from the group consisting of Mn, Fe and Cu, an aluminum-based alloy possessing a high bearing force and hardness, which endured bending and could undergo processing, was obtainable when the atomic percentages satisfied the relationships of $50 \leqq Al \leqq 95$, $0.5 \leqq Co \leqq 35$, and $0.5 \leqq M'' \leqq 20$.

Furthermore it is also clear from the results shown in Tables 5 to 7 that when element L is added to a Al—$Fe_2$—component alloy, wherein L is one or more elements selected from the group consisting of Mn and Cu, an aluminum-based alloy possessing a high bearing force and hardness, which endured bending and could undergo processing, was obtainable when the atomic percentages satisfied the relationships of $50 \leqq Al \leqq 95$, $0.5 \leqq Fe \leqq 35$, and $0.5 \leqq L \leqq 20$.

In contrast to normal aluminum-based alloys which possess an Hv of approximately 50 to 100 DPN, the samples according to the present invention shown in Tables 5 and 7 display an extremely high hardness ranging from 165 to 387 DPN.

In addition, in regards to the tensile rupture strength (σf), normal age hardened type aluminum-based alloys (Al—Si—Fe type) possess values from 200 to 600 MPa, however, the samples according to the present invention have clearly superior values in the range from 760 to 1270 MPa.

Furthermore, when considering that the tensile strengths of aluminum-based alloys of the AA6000 series and AA7000 series which lie in the range from 250 to 300 MPa, Fe-type structural steel sheets which possess a value of approximately 400 MPa, and high tensile strength steel sheets of Fe-type which range from 800 to 980 MPa, it is clear that the aluminum-based alloys according to the present invention display superior values.

Figure 25:
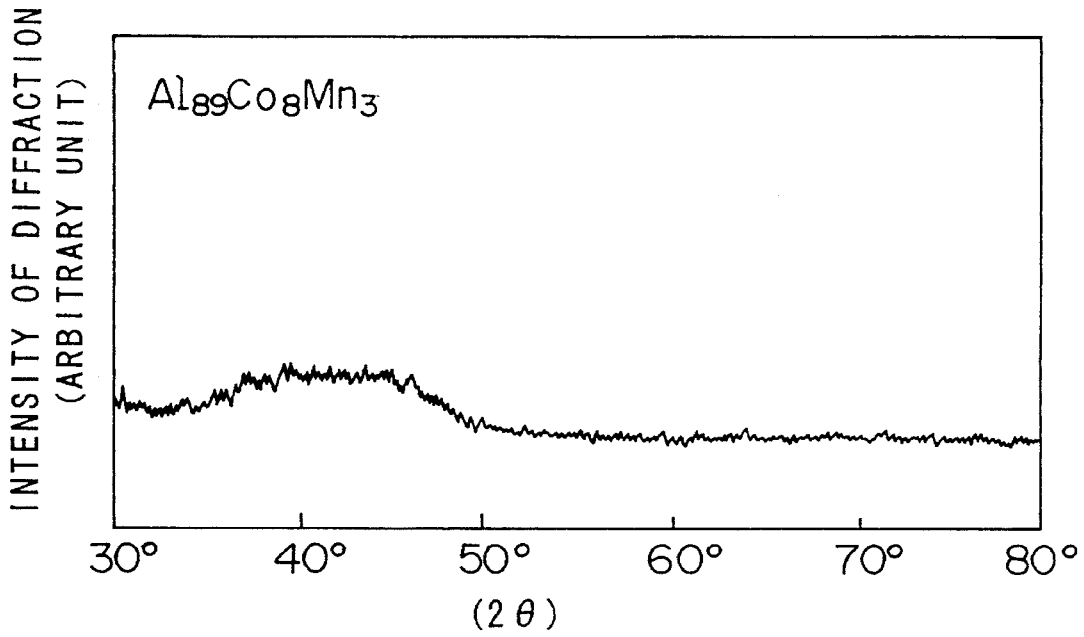
FIG. 25 shows the analysis result of the X-ray diffraction of an alloy having the composition of $Al_{89}Co_8Mn_3$.

FIG. 25 shows the analysis result of the X-ray diffraction of an alloy having the composition of $Al_{89}Co_8Mn_3$. In this FIG., the crystal peak (not discernible) appears as a broad peak pattern with the alloy sample displaying an amorphous single phase structure.

Figure 26:
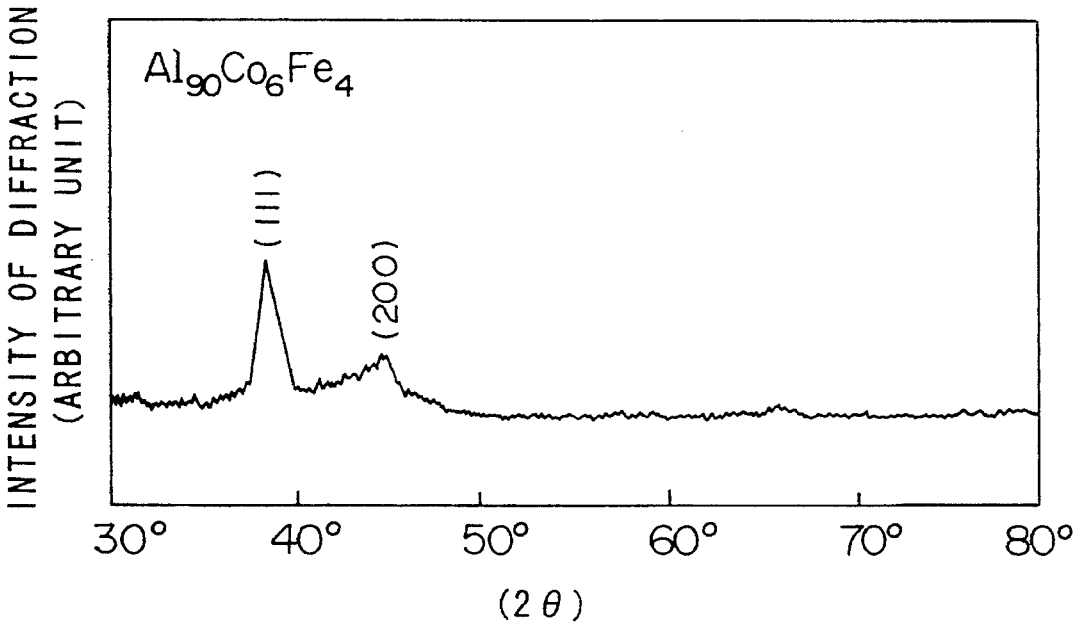
FIG. 26 shows the analysis result of the X-ray diffraction of an alloy having the composition of $Al_{90}Co_6Fe_4$.

FIG. 26 shows the analysis result of the X-ray diffraction of an alloy having the composition of $Al_{90}Co_6Fe_4$. In this FIG., a multiphase structure is displayed which comprises an amorphous phase and a fine Al crystalline phase having an fcc structure of the nanoscale. In the FIG., (111) and (200) display the crystal peaks of Al having an fcc structure.

Figure 27:
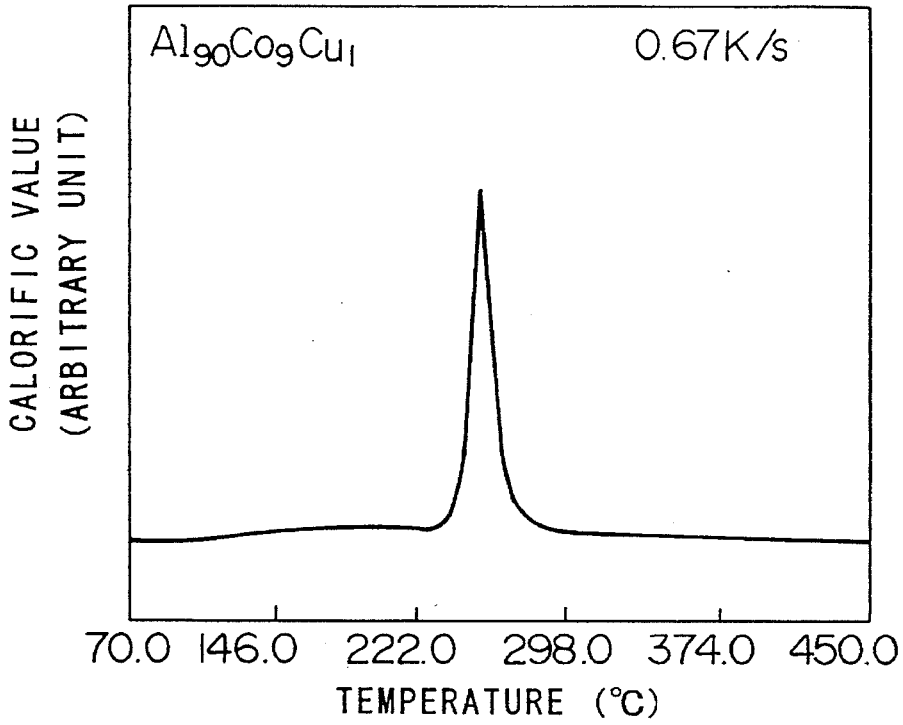
FIG. 27 shows the thermal properties of an alloy having the composition of $Al_{90}Co_9Cu_1$.

FIG. 27 shows the DSC (Differential Scanning Calorimetry) curve in the case when an alloy having the composition of $Al_{90}Co_9Cu_1$ is heated at an increase temperature rate of 0.67 K/s.

Figure 28:
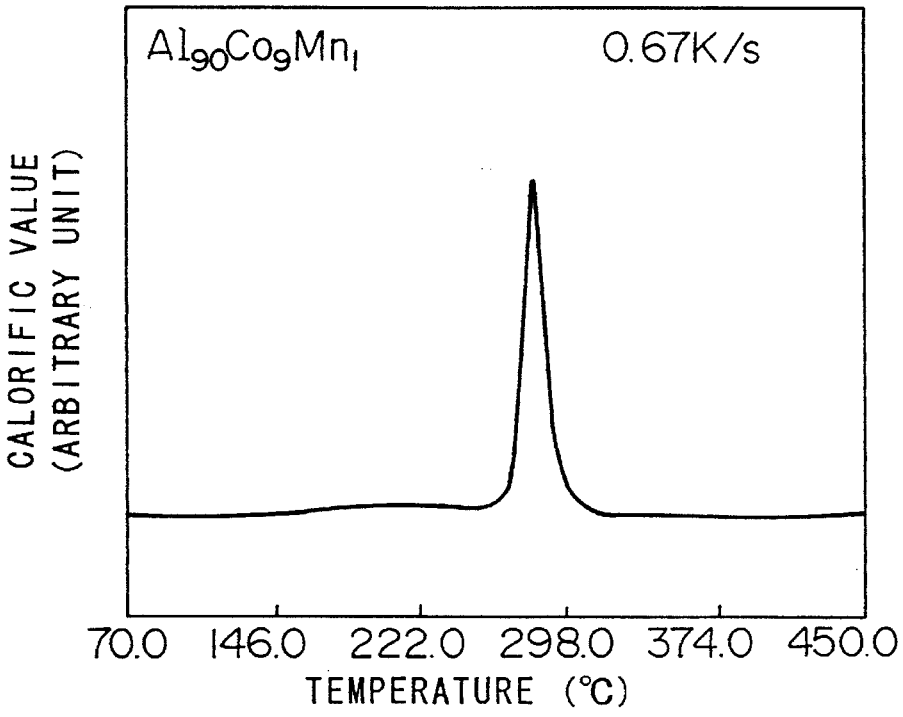
FIG. 28 shows the thermal properties of an alloy having the composition of $Al_{90}Co_9Mn_1$.

FIG. 28 shows the DSC curve in the case when an alloy having the composition of $Al_{90}Co_9Mn_1$ is heated at an increase temperature rate of 0.67 K/s.

As is clear from FIGS. 27 and 28, the broad peak appearing at lower temperatures represents the crystallization peak of Al particles having an fcc structure, while the sharp peak at higher temperatures represents the crystallization peak of the alloys. Due to the existence of these two peaks, when performing heat treatment such as quench hardening at an appropriate temperature, the volume percentage of the Al particles dispersed into the amorphous matrix phase can be controlled. As a result, it is clear that the mechanical properties can be improved through heat treatment.

In addition, in order to show criticality of the aforementioned composition ratios of $50 \leqq Al \leqq 95$, $0.5 \leqq Co \leqq 35$, and $0.5 \leqq M'' \leqq 20$ for $Al_xCo_yM''_z$, or of $50 \leqq Al \leqq 95$, $0.5 \leqq Fe \leqq 35$, and $0.5 \leqq L \leqq 20$ for $Al_aFe_bL_c$, FIGS. 29–38 are provided.

Figure 29:
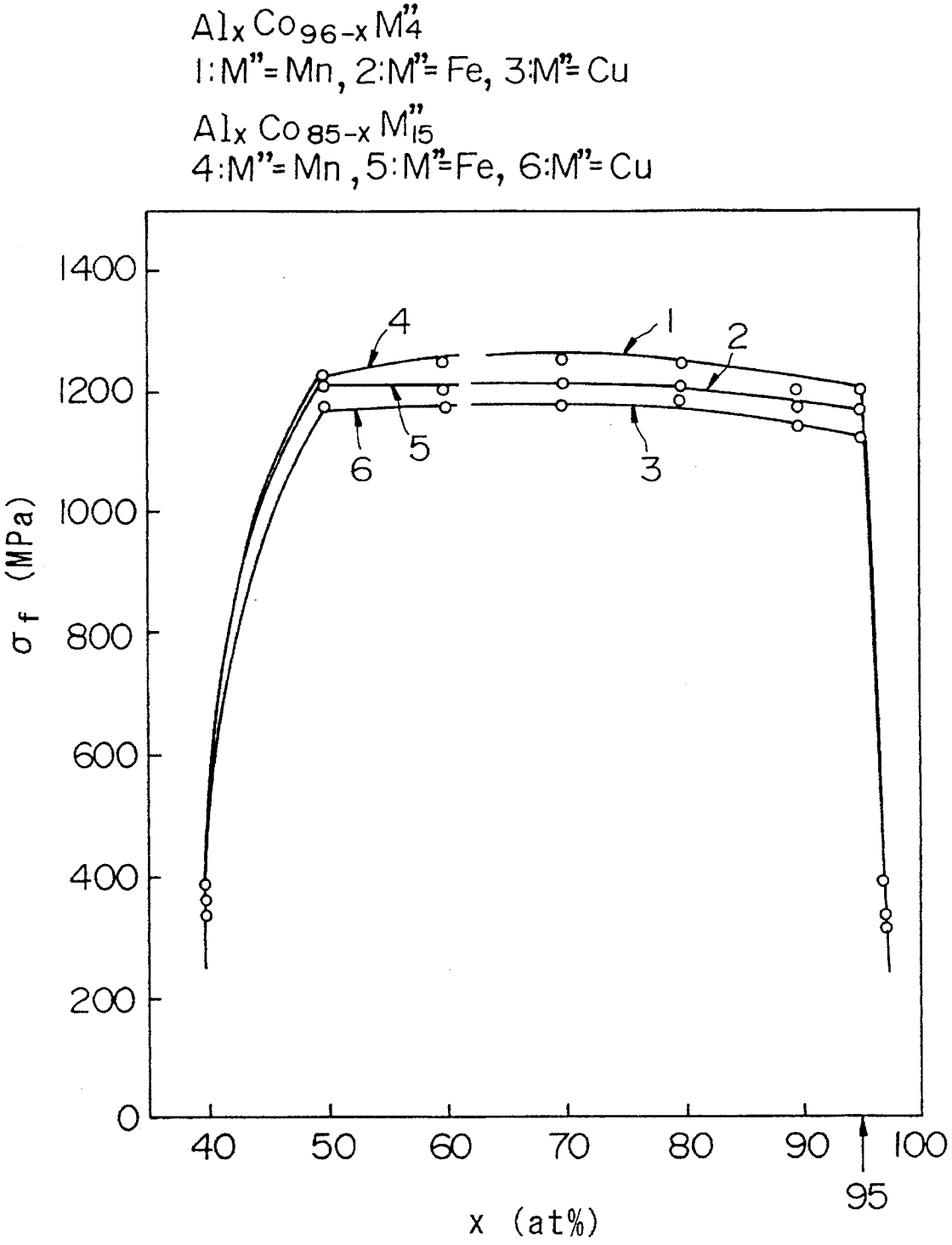
FIG. 29 is a graph showing variation of the tensile rupture strength of alloys having the compositions of $Al_xCo_{96-x}M''_4$ and $Al_xCo_{85-x}M''_{15}$ corresponding to various values of x.

The graph in FIG. 29 shows variation of the tensile rupture strength (σf) of alloys having the compositions of $Al_xCo_{96-x}M''_4$ and $Al_xCo_{85-x}M''_{15}$ (in which element M" is Mn, Fe, or Cu) corresponding to various values of x. According to this graph, it can be seen that an alloy having a composition of $Al_xCo_yM''_z$ in which the atomic percentage for Al is less than 50% or exceeds 95% is undesirable, since such an alloy may not have sufficient strength.

Figure 30:
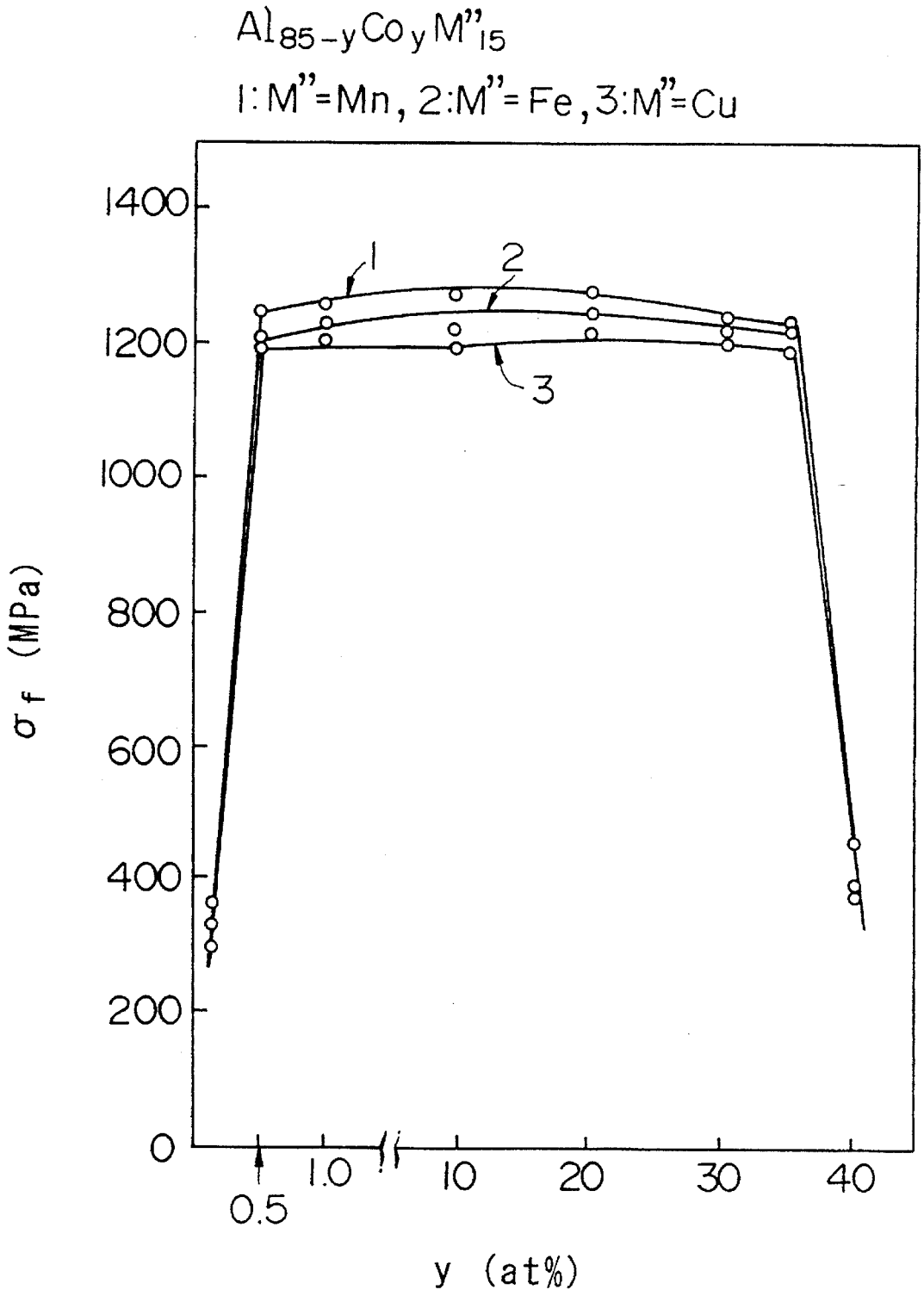
FIG. 30 is a graph showing variation of the tensile rupture strength of alloys having the compositions of $Al_{85-y}Co_yM''_{15}$ corresponding to various values of y.

The graph in FIG. 30 shows variation of the tensile rupture strength (σf) of alloys having the compositions of $Al_{85-y}Co_yM''_{15}$ (in which element M" is Mn, Fe, or Cu) corresponding to various values of y. According to this graph, it can be seen that an alloy having a composition of $Al_xCo_yM''_z$ in which the atomic percentage for Co is less than 0.5% or exceeds 35% is undesirable, since such an alloy may not have sufficient strength.

Figure 31:
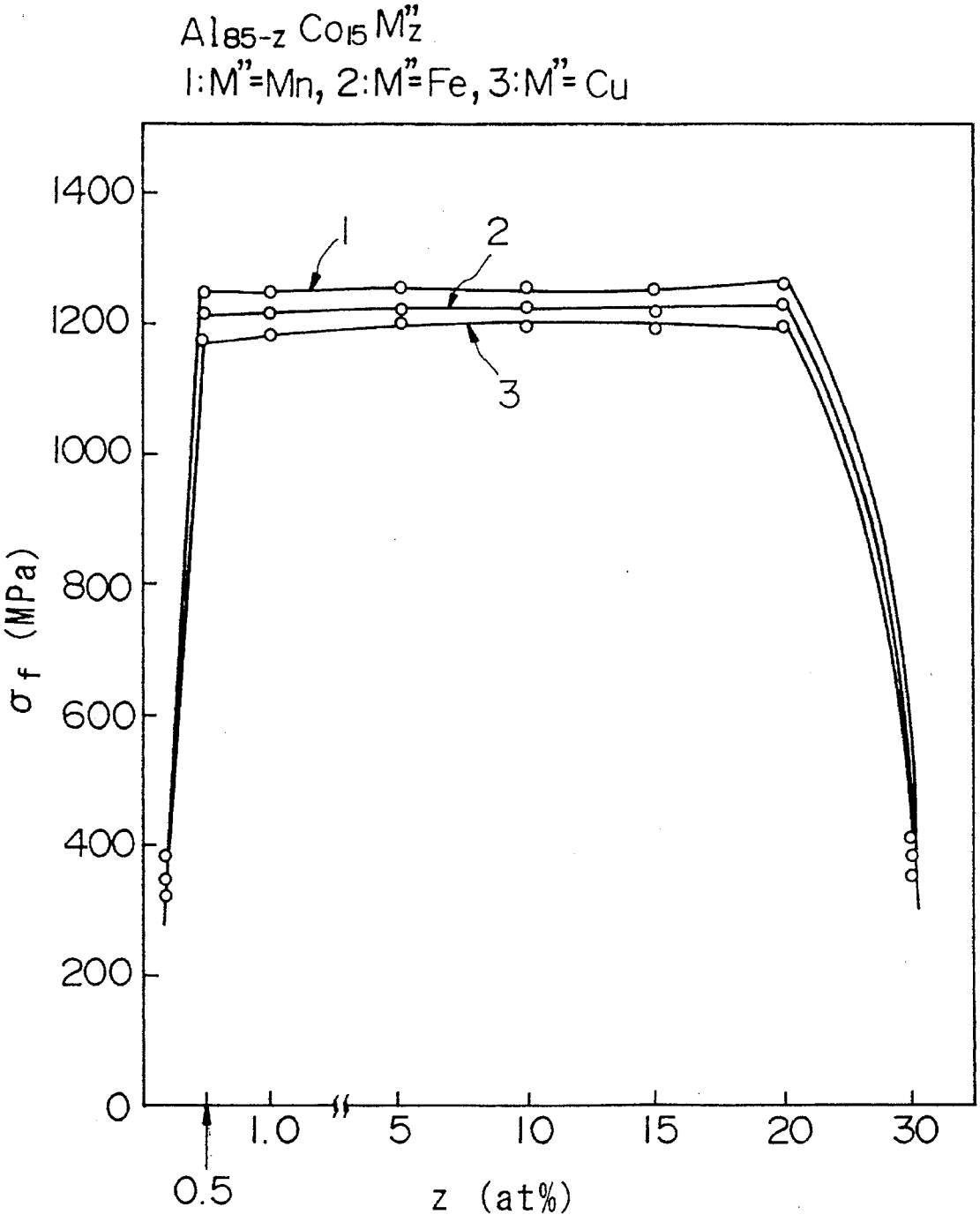
FIG. 31 is a graph showing variation of the tensile rupture strength of alloys having the compositions of $Al_{85-z}Co_{15}M''_z$ corresponding to various values of z.

The graph in FIG. 31 shows variation of the tensile rupture strength (σf) of alloys having the compositions of $Al_{85-z}Co_{15}M''_z$ (in which element M" is Mn, Fe, or Cu) corresponding to various values of z. According to this graph, it can be seen that an alloy having a composition of $Al_xCo_yM''_z$ in which the atomic percentage for element M" is less than 0.5% or exceeds 20% is undesirable, since such an alloy may not have sufficient strength.

Figure 32:
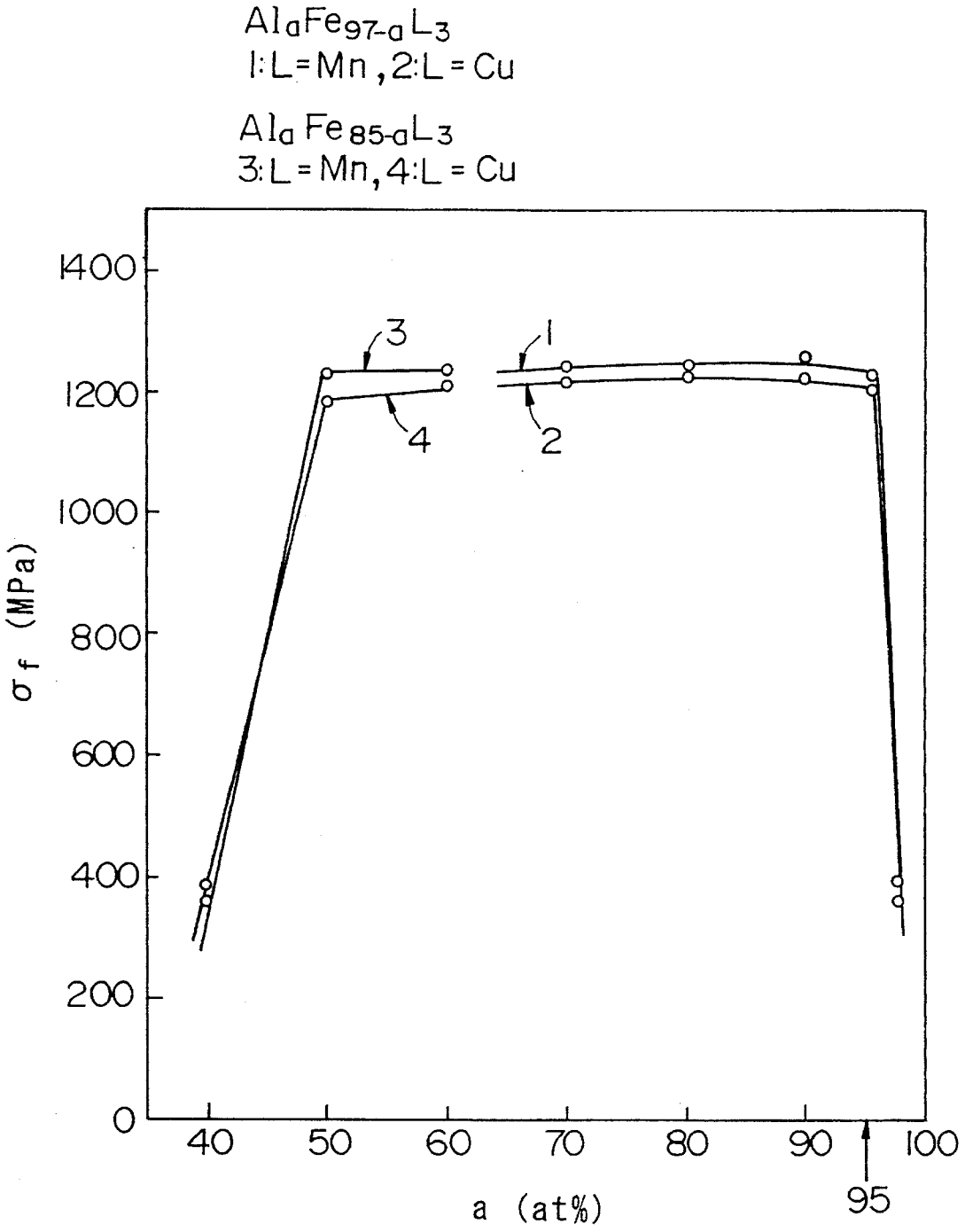

The graph in FIG. 32 shows variation of the tensile rupture strength (σf) of alloys having the compositions of $Al_aFe_{97-a}L_3$ and $Al_aFe_{85-a}L_3$ (in which L is Mn or Cu) corresponding to various values of a. According to this graph, it can be seen that an alloy having a composition of $Al_aFe_bL_c$ in which the atomic percentage for Al is less than 50% or exceeds 95% is undesirable, since such an alloy may not have sufficient strength.

Figure 33:
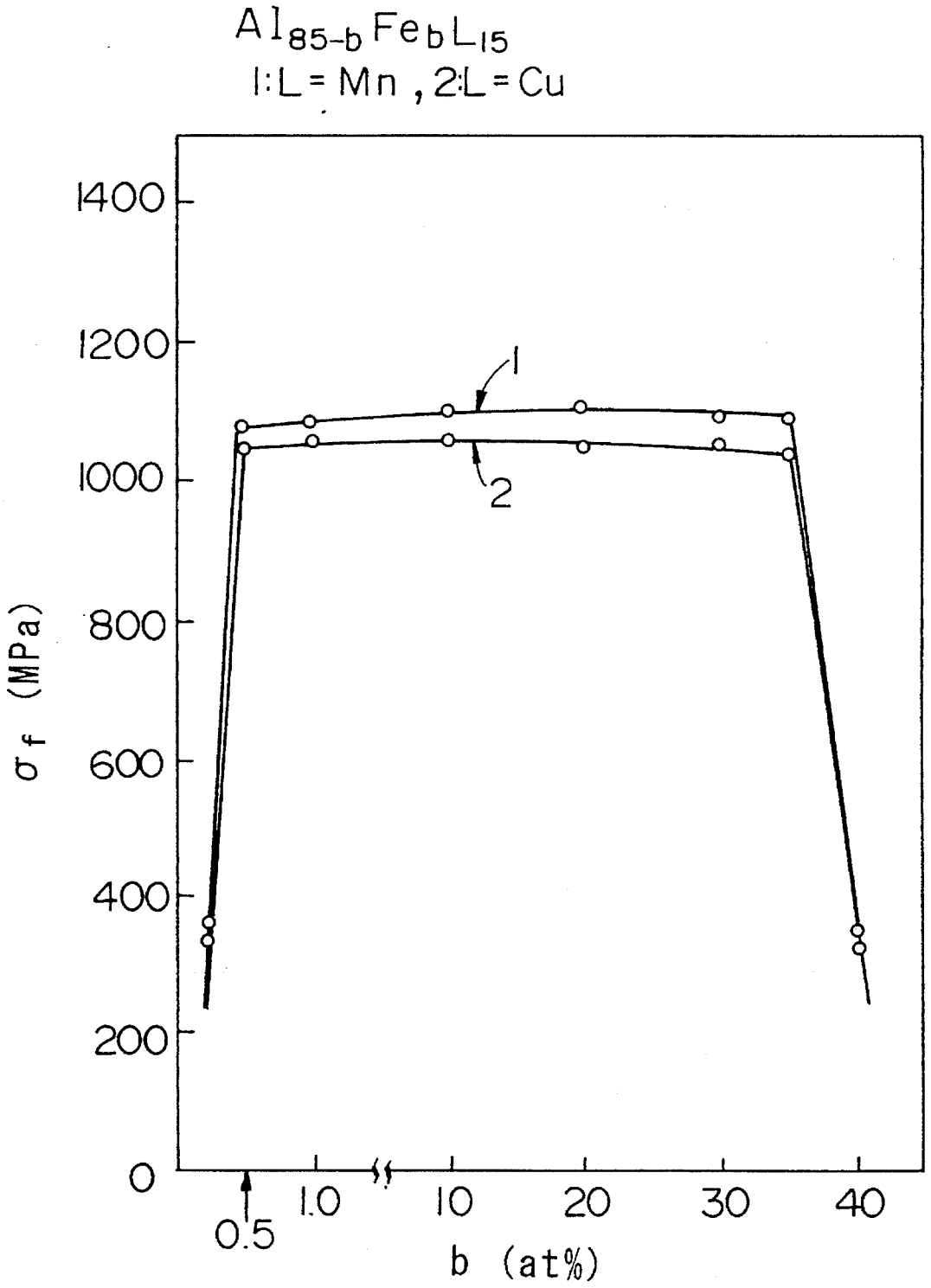
FIG. 33 is a graph showing variation of the tensile rupture strength of alloys having the compositions of $Al_{85-b}Fe_bL_{15}$ corresponding to various values of b.

The graph in FIG. 33 shows variation of the tensile rupture strength (σf) of alloys having the compositions of $Al_{85-b}Fe_bL_{15}$ (in which L is Mn or Cu) corresponding to various values of b. According to this graph, it can be seen that an alloy having a composition of $Al_aFe_bL_c$ in which the atomic percentage for Fe is less than 0.5% or exceeds 35% is undesirable, since such an alloy may not have sufficient strength.

Figure 34:
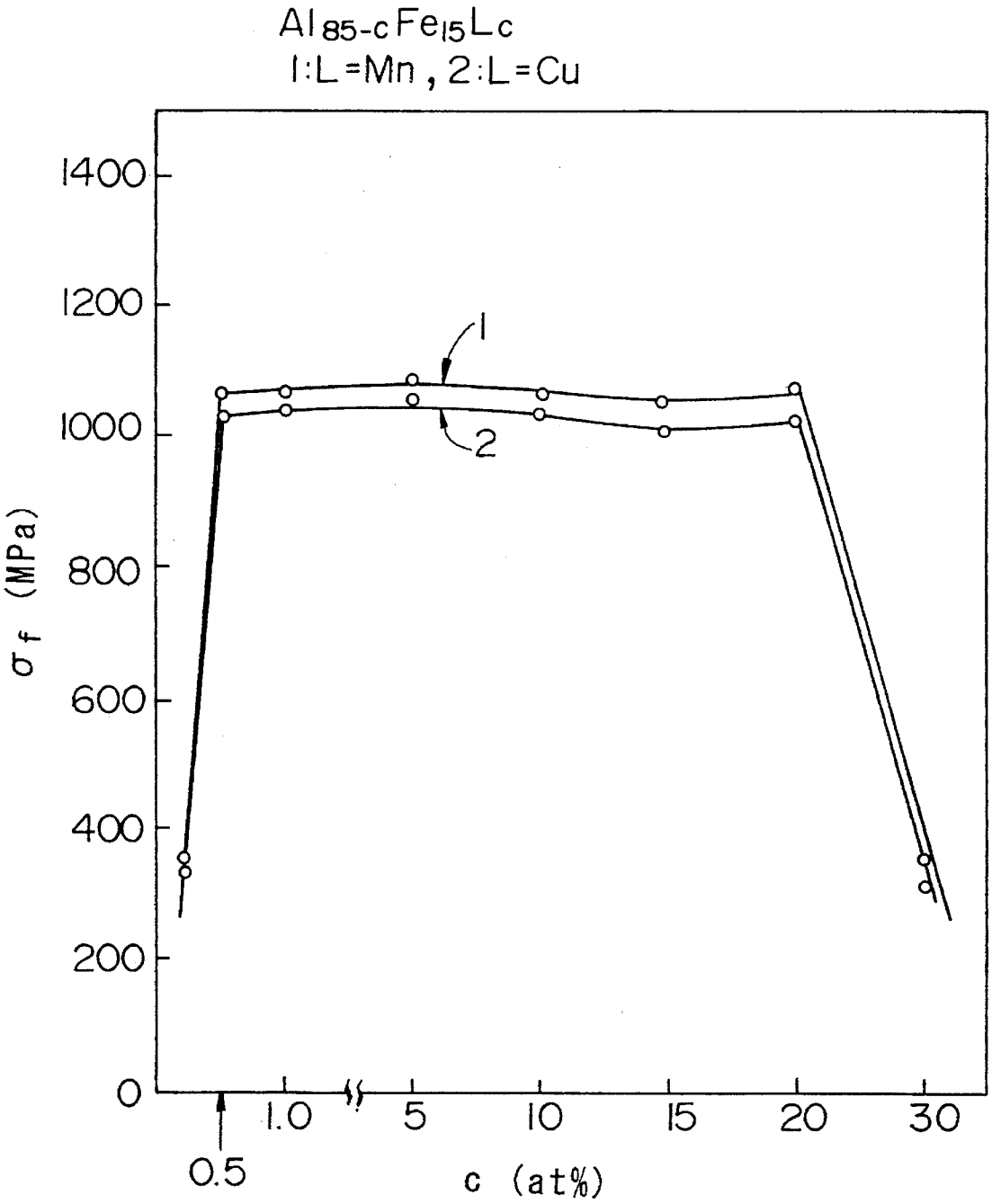
FIG. 34 is a graph showing variation of the tensile rupture strength of alloys having the compositions of $Al_{85-c}Fe_{15}L_c$ corresponding to various values of c.

The graph in FIG. 34 shows variation of the tensile rupture strength (σf) of alloys having the compositions of $Al_{85-c}Fe_{15}L_c$ (in which L is Mn or Cu) corresponding to various values of c. According to this graph, it can be seen that an alloy having a composition of $Al_aFe_bL_c$ in which the atomic percentage for L is less than 0.5% or exceeds 20% is undesirable, since such an alloy may not have sufficient strength.

Figure 35:
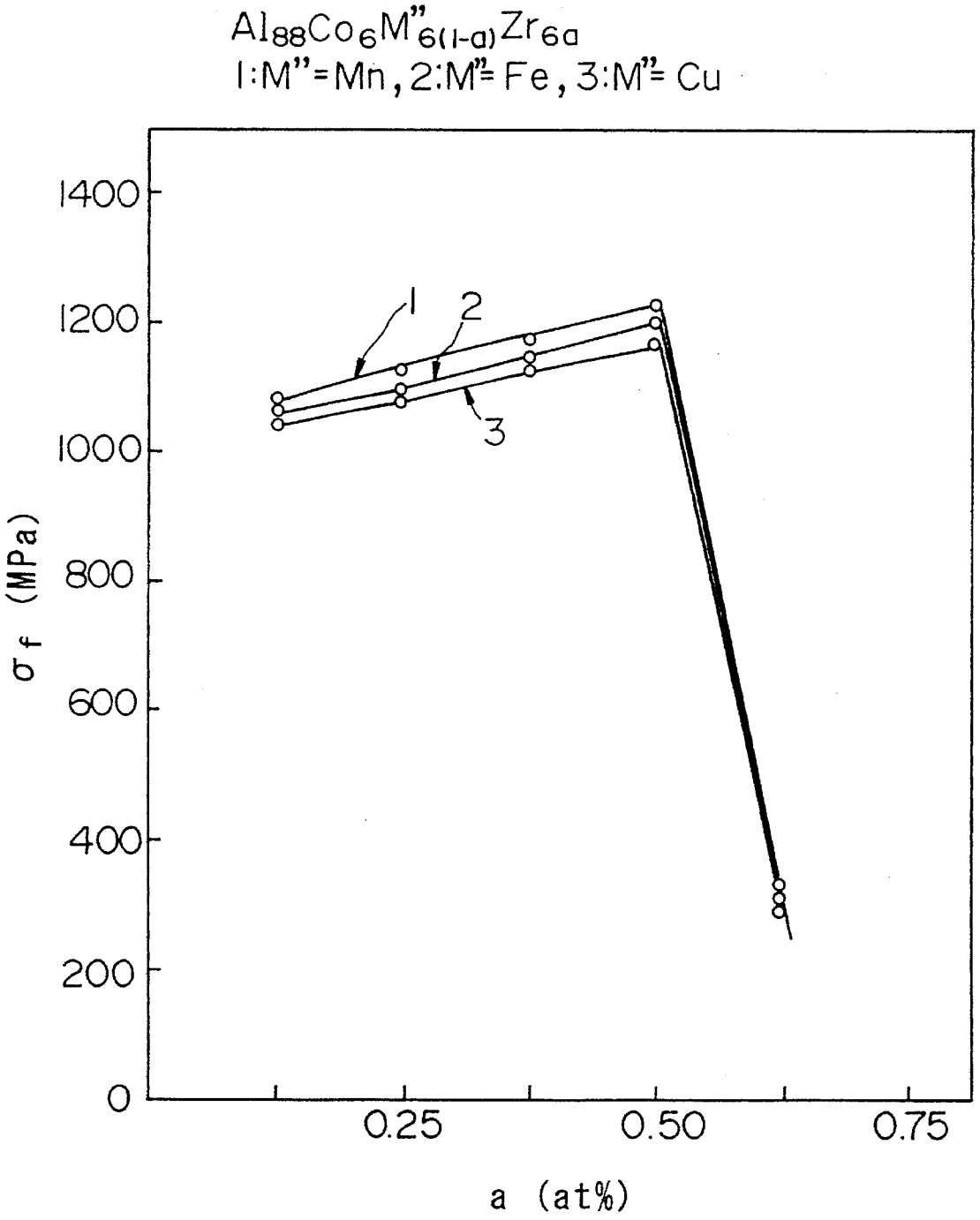

The graph in FIG. 35 shows variation of the tensile rupture strength (σf) of alloys having the compositions of $Al_{88}Co_6M''_{6(1-a)}Zr_{6a}$ (in which element M" is Mn, Fe, or Cu) corresponding to various values of a. According to this graph, it can be seen that an alloy having a composition of $Al_xCo_yM''_z$ in which a part of element M" is substituted by Zr but in which the atomic percentage for Zr exceeds onehalf of that of element M" is undesirable, since such an alloy may not have sufficient strength.

Figure 36:
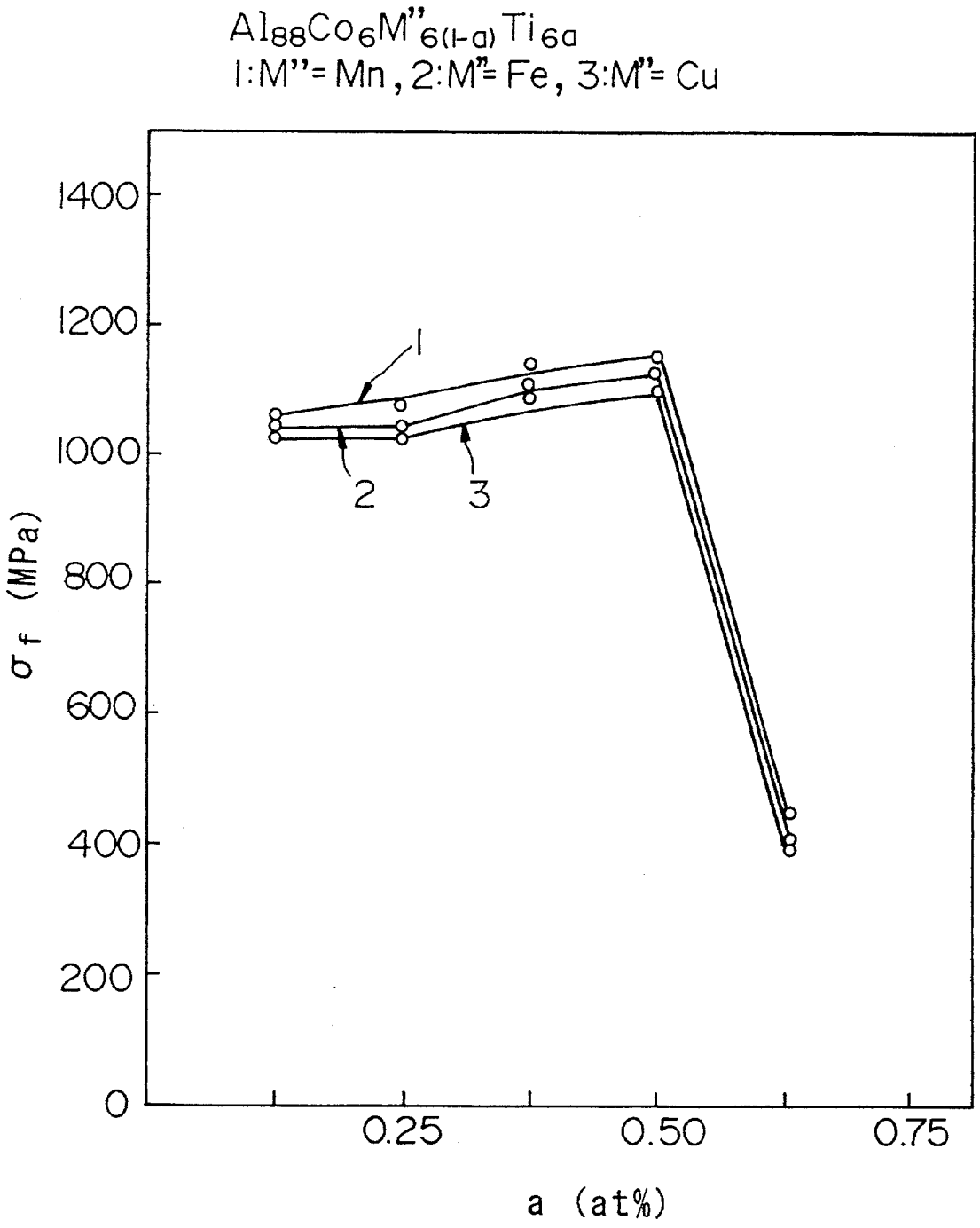

The graph in FIG. 36 shows variation of the tensile rupture strength (σf) of alloys having the compositions of $Al_{88}Co_6M''_{6(1-a)}Ti_{6a}$ (in which element M" is Mn, Fe, or Cu) corresponding to various values of a. According to this graph, it can be seen that an alloy having a composition of $Al_xCo_yM''_z$ in which a part of element M" is substituted by Ti but in which the atomic percentage for Ti exceeds one-half of that of element M" is undesirable, since such an alloy may not have sufficient strength.

Figure 37:
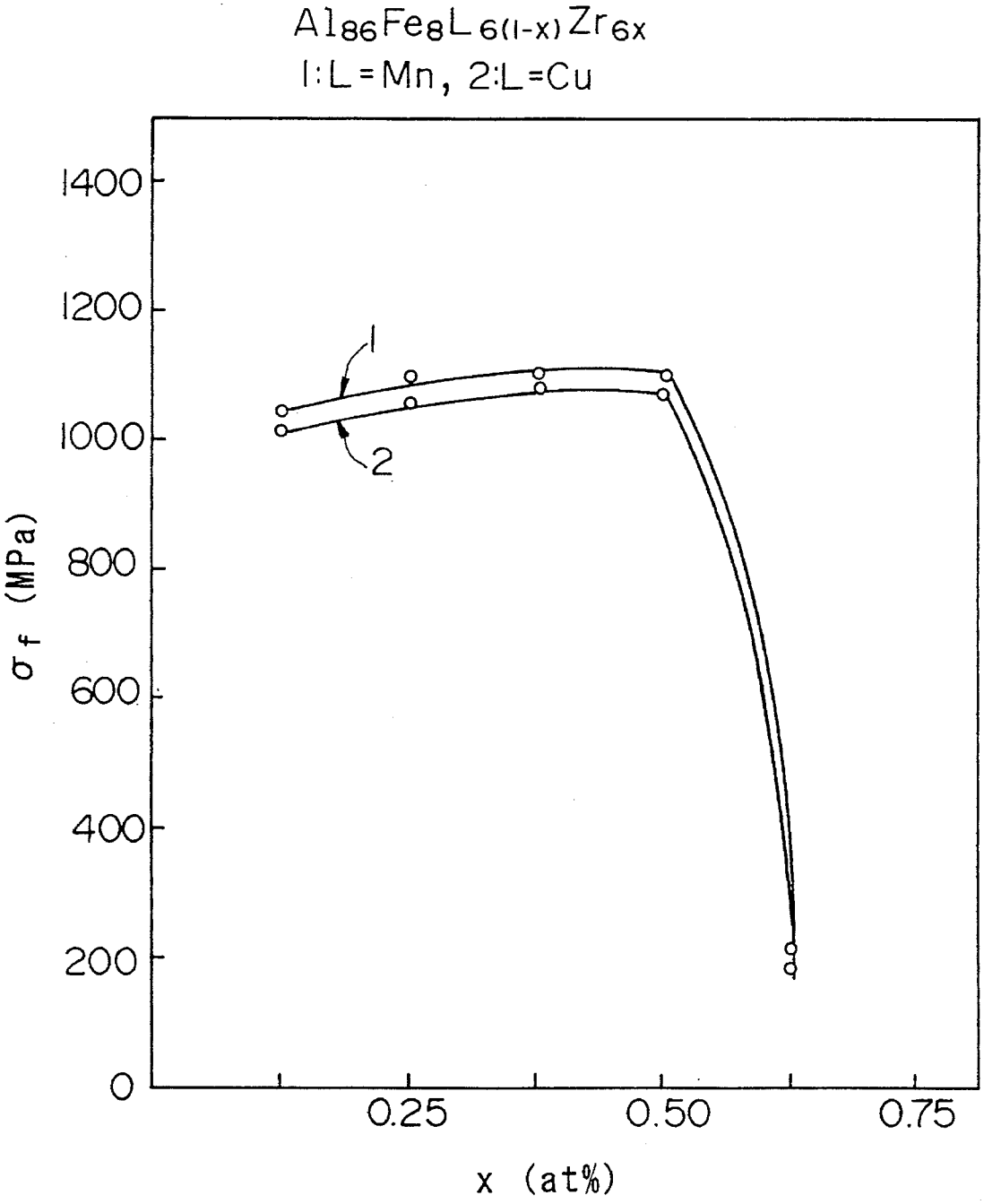
FIG. 37 is a graph showing variation of the tensile rupture strength of alloys having the compositions of $Al_{86}Fe_8L_{6(1-x)}Zr_{6x}$ corresponding to various values of x.

The graph in FIG. 37 shows variation of the tensile rupture strength (σf) of alloys having the compositions of $Al_{86}Fe_8L_{6(1-x)}Zr_{6x}$ (in which L is Mn or Cu) corresponding to various values of x. According to this graph, it can be seen that an alloy having a composition of $Al_aFe_bL_c$ in which a part of L is substituted by Zr but in which the atomic percentage for Zr exceeds one-half of that of L is undesirable, since such an alloy may not have sufficient strength.

Figure 38:
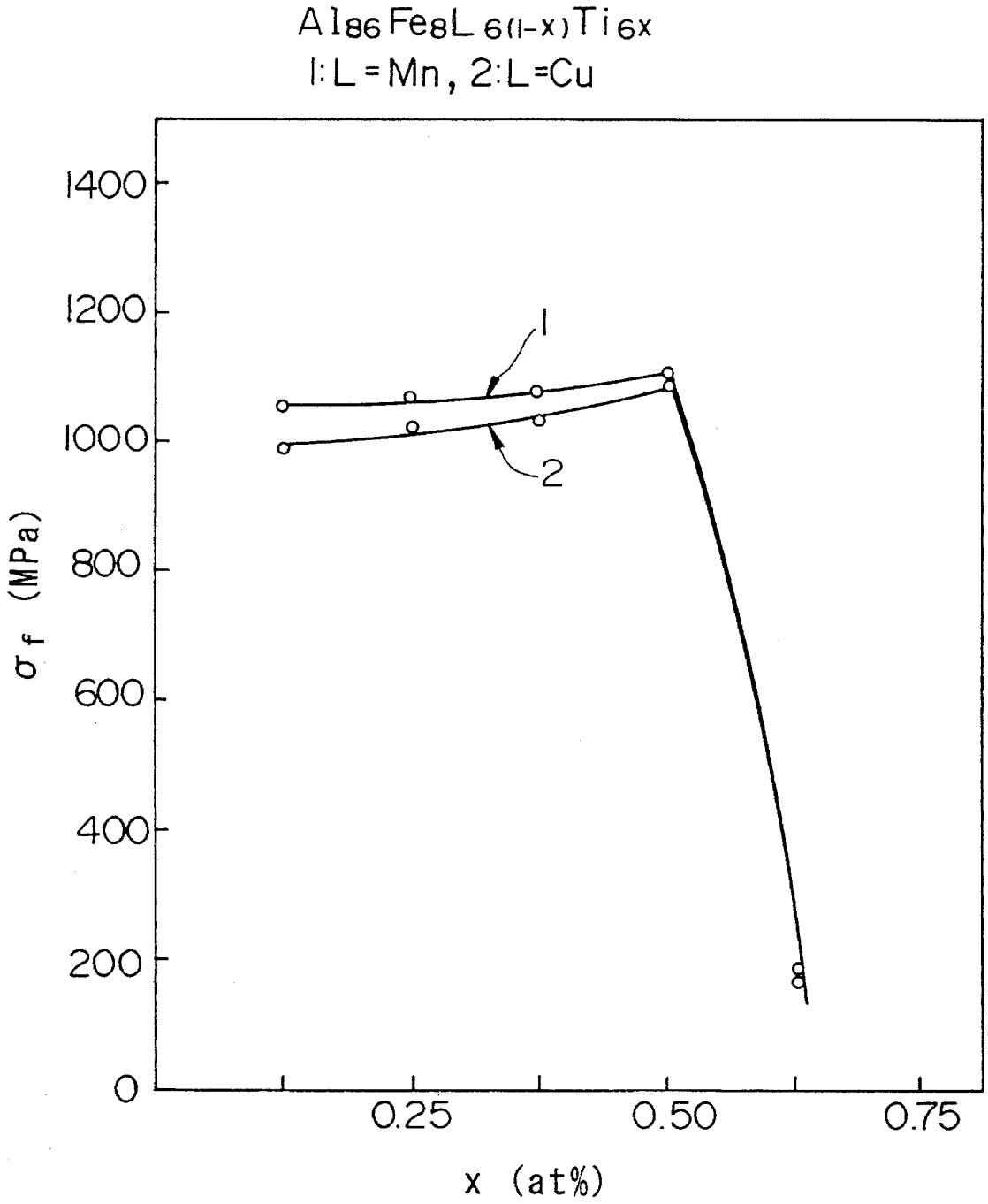
FIG. 38 is a graph showing variation of the tensile rupture strength of alloys having the compositions of $Al_{86}Fe_8L_{6(1-x)}Ti_{6x}$ corresponding to various values of x.

The graph in FIG. 38 shows variation of the tensile rupture strength (σf) of alloys having the compositions of $Al_{86}Fe_8L_{6(1-x)}Ti_{6x}$ (in which L is Mn or Cu) corresponding to various values of x. According to this graph, it can be seen that an alloy having a composition of $Al_aFe_bL_c$ in which a part of L is substituted by Ti but in which the atomic percentage for Ti exceeds one-half of that of L is undesirable, since such an alloy may not have sufficient strength.

[Comparative Tests]

U.S. Pat. No. 4,595,429 (Le Caér, et al.) discloses alloys having the composition $Al_aM_bM'_cX_dY_e$, in which:

50≦a≦95 atom %; M representing one or more metals of the group Mn, Ni, Cu, Zr, Ti, C, Cr, Fe, and Co, with 0≦b≦40 atom %; M' representing Mo and/or W, with 0≦c≦15 atom %; X representing one or more elements of the group Ca, Li, Mg, Ge, Si, and Zn, with 0≦d≦20 atom %; and Y representing impurities such as O, N, C, H, He, Ga, etc., the proportions of which does not exceed 3 atom %.

In order to determine differences in bending ductility and tensile strength between the compositions of Le Caér, et al., and those of the present invention, several alloys were prepared and tested in accordance with anomalous X-ray scattering (AXS). The results are shown in FIGS. 39–42.

Although the alloys according to Le Caér, et al., are similar in composition to the alloys according to the present invention, the alloys of Le Caér, et al., do not possess sufficient bending ductility or tensile strength.

Figure 39:
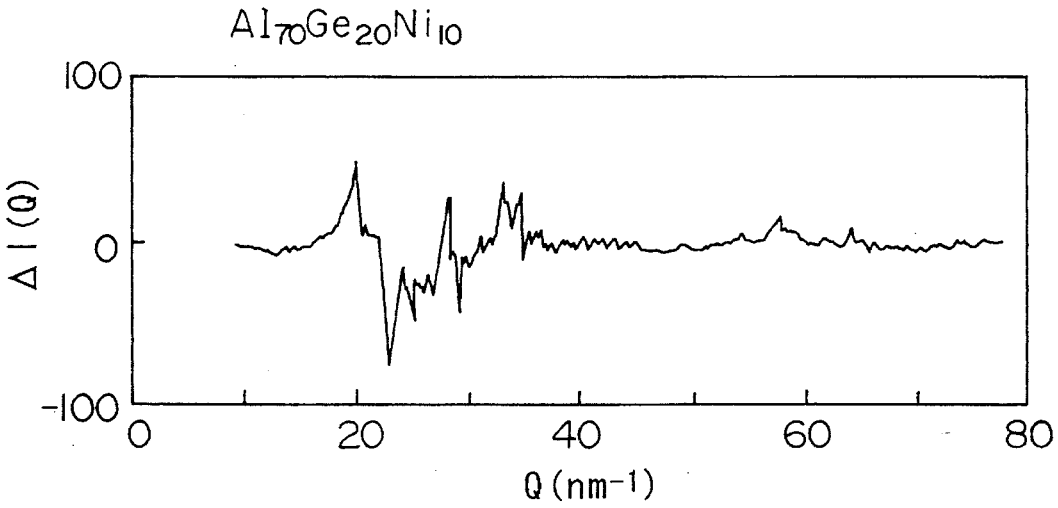
FIG.39 (PRIOR ART)
FIG. 39 is a graph showing structure-analysis data of an alloy having the composition of $Al_{70}Ge_{20}Ni_{10}$, which was obtained in accordance with anomalous X-ray scattering.

The graph in FIG. 39 shows structure-analysis data of an alloy according to Le Caér, et al., having the composition of $Al_{70}Ge_{20}Ni_{10}$. It is noted that this composition corresponds to a composition of Le Caér, et al., in which a=70, M is Ni, b=10, c=0, X is Ge, d=20, and e=0.

Figure 40:
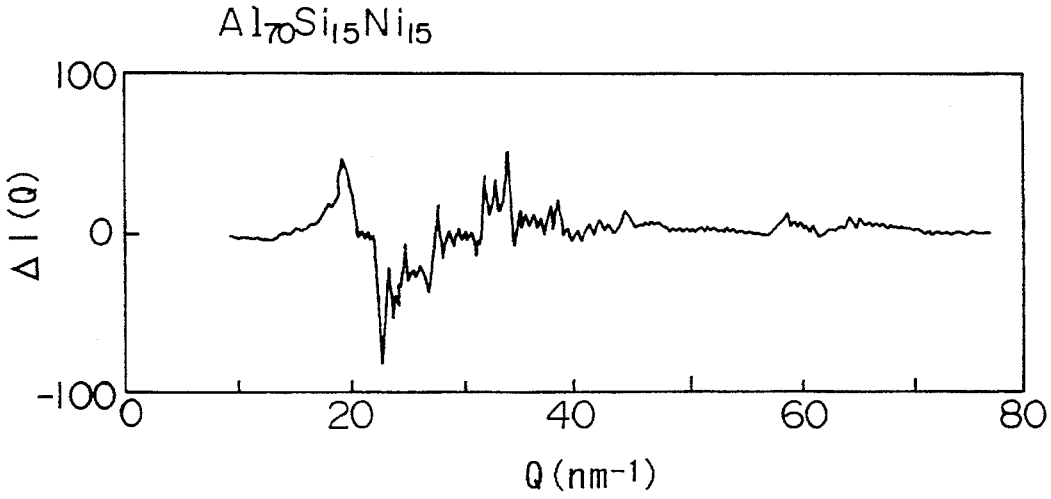
FIG.40 (PRIOR ART)
FIG. 40 is a graph showing structure-analysis data of an alloy having the composition of $Al_{70}Si_{15}Ni_{15}$, which was obtained in accordance with anomalous X-ray scattering.

The graph in FIG. 40 shows structure-analysis data of an alloy according to Le Caér, et al., having the composition of $Al_{70}Si_{15}Ni_{15}$. It is noted that this composition corresponds to a composition of Le Caér, et al., in which a=70, M is Ni, b=15, c=0, X is Si, d=15, and e=0.

Figure 41:
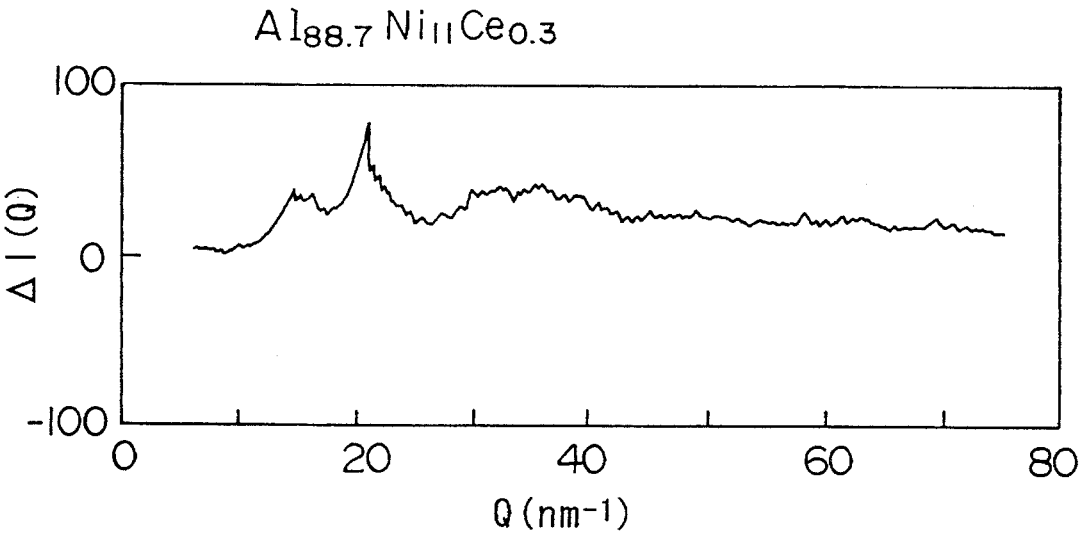
FIG. 41 is a graph showing structure-analysis data of an alloy having the composition of $Al_{88.7}Ni_{11}Ce_{0.3}$, which was obtained in accordance with anomalous X-ray scattering.

FIG. 41 is a graph showing structure-analysis data of an alloy according to the present invention having the composition of $Al_{88.7}Ni_{11}Ce_{0.3}$.

Figure 42:
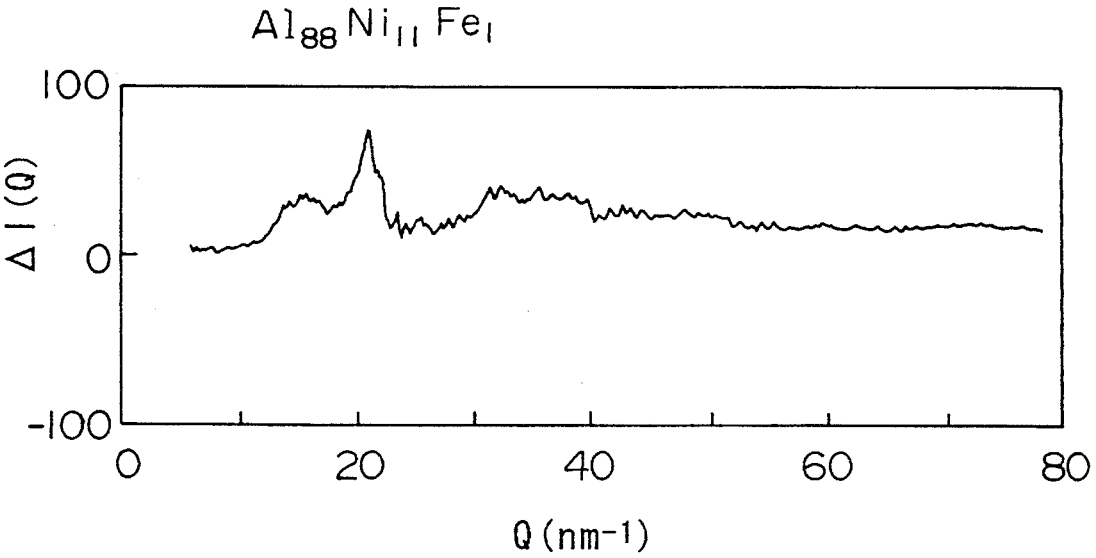
FIG. 42 is a graph showing structure-analysis data of an alloy having the composition of $Al_{88}Ni_{11}Fe_1$, which was obtained in accordance with anomalous X-ray scattering.

FIG. 42 is a graph showing structure-analysis data of an alloy according to the present invention having the composition of $Al_{88}Ni_{11}Fe_1$.

In these graphs in FIGS. 39–42, one axis (Q) represents the wave number vector, and the other axis (ΔI(Q)) represents the differential intensity profile at incident energy.

According to the graphs of FIGS. 39 and 40, the differential intensity profile values are partially negative, and this indicates the existence of a short periodical regular array of elements which produces a brittle amorphous structure. Accordingly, these alloys do not have bending ductility. In contrast, it can be seen from the graphs of FIGS. 41 and 42 showing data of alloys according to the present invention that the differential intensity profile is always positive for any value of the wave number vector. This indicates that the amorphous structures of the alloys according to the present invention are homogeneous, on the whole, and the alloys exhibit bending ductility. This makes a test of the tensile strength possible and it is found that the alloys of the present invention possess a high strength of over 750 MPa and a desirable Vickers hardness in the range of 150–385.

Although the invention has been described in detail herein with reference to its preferred embodiments and certain described alternatives, it is to be understood that this description is by way of example only, and it is not to be construed in a limiting sense. It is further understood that numerous changes in the details of the embodiments of the invention, and additional embodiments of the invention, will be apparent to, and may be made by persons of ordinary skill in the art having reference to this description. It is contemplated that all such changes and additional embodiments are within the spirit and true scope of the invention as claimed below.

TABLE 1

| Sample No. | Alloy composition (at %) | σf (MPa) | Hv (DPN) | Structural state | Bending test |
|---|---|---|---|---|---|
| 1 | $Al_{89.6}Ni_5Co_5Ce_{0.4}$ | 1240 | 317 | fcc-Al + Amo | Duc |
| 2 | $Al_{88.7}Ni_{11}Nd_{0.3}$ | 1170 | 305 | fcc-Al + Amo | Duc |
| 3 | $Al_{88.7}Ni_{11}La_{0.3}$ | 1050 | 260 | amorphous | Duc |
| 4 | $Al_{88.7}Ni_{11}Ce_{0.3}$ | 1030 | 272 | amorphous | Duc |
| 5 | $Al_{88.7}Cu_{11}Y_{0.3}$ | 1190 | 310 | fcc-Al + Amo | Duc |
| 6 | $Al_{88.7}Mn_{11}Ce_{0.3}$ | 910 | 307 | fcc-Al + Amo | Duc |
| 7 | $Al_{88.7}Fe_{11}Mn_{0.3}$ | 900 | 298 | fcc-Al + Amo | Duc |
| 8 | $Al_{87.6}Ni_{11}Cr_1Y_{0.4}$ | 800 | 340 | fcc-Al + Amo | Duc |
| 9 | $Al_{87.6}Ni_{11}V_1Y_{0.4}$ | 840 | 305 | amorphous | Duc |
| 10 | $Al_{87.6}Ni_{11}Ti_1Y_{0.4}$ | 1030 | 332 | amorphous | Duc |
| 11 | $Al_{87.6}Ni_{11}Zr_1Ce_{0.4}$ | 960 | 280 | amorphous | Duc |
| 12 | $Al_{87.6}Ni_{11}Nb_1Ce_{0.4}$ | 980 | 317 | fcc-Al + Amo | Duc |
| 13 | $Al_{87.6}Ni_{11}Mo_1Ce_{0.4}$ | 1020 | 320 | fcc-Al + Amo | Duc |

TABLE 2

| Sample No. | Alloy composition (at %) | σf (MPa) | Hv (DPN) | Structural state | Bending test |
|---|---|---|---|---|---|
| 14 | $Al_{60.7}Fe_{39}Y_{0.3}$ | —*1 | 520 | Crystalline | Bri |
| 15 | $Al_{98.7}Fe_1Ce_{0.3}$ | 440 | 120 | fcc-Al | Duc |
| 16 | $Al_{99.7}Ce_{0.3}$ | 400 | 107 | fcc-Al | Duc |
| 17 | $Al_{60}Fe_{40}$ | —*1 | 520 | Crystalline | Bri |

*1Tensile test could not be conducted due to brittle nature.

TABLE 3

| Sample No. | Alloy composition (at %) | σf (MPa) | Hv (DPN) | Structural state | Bending test |
|---|---|---|---|---|---|
| 18 | $Al_{88}Ni_7Co_5$ | 1065 | 316 | amorphous | Duc |
| 19 | $Al_{88}Ni_8Co_4$ | 1061 | 313 | amorphous | Duc |
| 20 | $Al_{88}Ni_9Co_3$ | 996 | 307 | amorphous | Duc |
| 21 | $Al_{88}Ni_{10}Co_2$ | 813 | 306 | fcc-Al + Amo | Duc |
| 22 | $Al_{88}Ni_{11}Co_1$ | 931 | 295 | fcc-Al + Amo | Duc |
| 23 | $Al_{88}Ni_8Fe_4$ | 1080 | 302 | fcc-Al + Amo | Duc |
| 24 | $Al_{88}Ni_9Fe_3$ | 960 | 309 | fcc-Al + Amo | Duc |
| 25 | $Al_{88}Ni_{10}Fe_2$ | 915 | 304 | fcc-Al + Amo | Duc |
| 26 | $Al_{88}Ni_{11}Fe_1$ | 928 | 311 | fcc-Al + Amo | Duc |
| 27 | $Al_{88}Ni_{11}Cu_1$ | 780 | 327 | fcc-Al + Amo | Duc |
| 28 | $Al_{88}Ni_{11}Mn_1$ | 930 | 302 | fcc-Al + Amo | Duc |
| 29 | $Al_{88}Ni_{11}V_1$ | 797 | 363 | fcc-Al + Amo | Duc |
| 30 | $Al_{88}Ni_{11}Ti_1$ | 1047 | 368 | fcc-Al + Amo | Duc |
| 31 | $Al_{88}Ni_{11}Zr_1$ | 954 | 276 | fcc-Al + Amo | Duc |

TABLE 4

| Sample No. | Alloy composition (at %) | σf (MPa) | Hv (DPN) | Structural state | Bending test |
|---|---|---|---|---|---|
| 32 | $Al_{90}Ni_5Co_5$ | 1150 | 380 | fcc-Al + Amo | Duc |
| 33 | $Al_{87}Ni_{12}Mn_1$ | 953 | 262 | amorphous | Duc |
| 34 | $Al_{88}Ni_7V_5$ | 1070 | 331 | fcc-Al + Amo | Duc |
| 35 | $Al_{95}Ni_{0.3}Cu_{4.7}$ | 420 | 117 | fcc-Al | Duc |
| 36 | $Al_{95}Ni_{0.3}Cu_{4.7}$ | 400 | 109 | fcc-Al | Duc |
| 37 | $Al_{95}Ni_{0.3}Fe_{4.7}$ | 450 | 123 | fcc-Al | Duc |
| 38 | $Al_{88}Mn_{12}$ | —*1 | 550 | Crystalline | Bri |
| 39 | $Al_{73}Ni_2Fe_{25}$ | —*1 | 570 | Crystalline | Bri |
| 40 | $Al_{50}Ni_{40}Fe_{10}$ | —*1 | 530 | Crystalline | Bri |
| 41 | $Al_{94.6}Ni_5Cu_{0.4}$ | 380 | 102 | fcc-Al | Duc |
| 42 | $Al_{94}Ni_6$ | 540 | 180 | fcc-Al | Duc |
| 43 | $Al_{96}Ni_2Co_2$ | 400 | 120 | fcc-Al | Duc |
| 44 | $Al_{55}Ni_{40}Fe_5$ | —*1 | 520 | Crystalline | Bri |

*1Tensile test could not be conducted due to brittle nature.

TABLE 5

| Sample No. | Alloy composition (Subscript numerals represent atomic percentage) | σf (MPa) | Hv (DPN) | Structural state | Bending test | |
|---|---|---|---|---|---|---|
| 45 | $Al_{98}Co_1Mn_1$ | 400 | 110 | fcc-Al | Duc | Comparative example |
| 46 | $Al_{95}Co_4Mn_1$ | 780 | 215 | fcc-Al | Duc | Example |
| 47 | $Al_{90}Co_8Mn_2$ | 1270 | 330 | fcc-Al + Amo | Duc | Example |
| 48 | $Al_{80}Co_{15}Mn_5$ | 1115 | 315 | fcc-Al + Amo | Duc | Example |
| 49 | $Al_{70}Co_{25}Mn_5$ | 1210 | 320 | fcc-Al + Amo | Duc | Example |
| 50 | $Al_{60}Co_{30}Mn_{10}$ | 980 | 370 | Amo + Com | Duc | Example |
| 51 | $Al_{50}Co_{30}Mn_{20}$ | 960 | 360 | Amo + Com | Duc | Example |
| 52 | $Al_{45}Co_{35}Mn_{20}$ | — | 550 | Com | Bri | Comparative example |
| 53 | $Al_{50}Co_{40}Mn_{10}$ | — | 490 | Com | Bri | Comparative example |
| 54 | $Al_{60}Co_{35}Mn_5$ | 960 | 370 | Amo + Com | Duc | Example |
| 55 | $Al_{65}Co_{30}Mn_5$ | 975 | 340 | fcc-Al + Amo | Duc | Example |
| 56 | $Al_{70}Co_{20}Mn_{10}$ | 1010 | 340 | fcc-Al + Amo | Duc | Example |
| 57 | $Al_{80}Co_{10}Mn_{10}$ | 1015 | 345 | fcc-Al + Amo | Duc | Example |
| 58 | $Al_{96}Co_1Mn_3$ | 760 | 180 | fcc-Al | Duc | Example |
| 59 | $Al_{95}Co_{0.5}Mn_{4.5}$ | 760 | 165 | fcc-Al | Duc | Example |
| 60 | $Al_{94}Co_{0.3}Mn_{5.7}$ | 445 | 85 | fcc-Al | Duc | Comparative example |

TABLE 6

| Sample No. | Alloy composition (Subscript numerals represent atomic percentage) | σf (MPa) | Hv (DPN) | Structural state | Bending test | |
|---|---|---|---|---|---|---|
| 61 | $Al_{70}Co_5Mn_{25}$ | — | 520 | Com | Bri | Comparative example |
| 62 | $Al_{72}Co_8Mn_{20}$ | 1195 | 360 | Amo + Com | Duc | Example |
| 63 | $Al_{80}Co_{10}Mn_{10}$ | 1145 | 320 | fcc-Al + Amo | Duc | Example |
| 64 | $Al_{89}Co_{10}Mn_1$ | 1230 | 387 | fcc-Al + Amo | Duc | Example |
| 65 | $Al_{91}Co_{8.5}Mn_{0.5}$ | 1200 | 330 | fcc-Al + Amo | Duc | Example |
| 66 | $Al_{89}Co_{10.7}Mn_{0.3}$ | 460 | 120 | fcc-Al + Amo | Duc | Comparative example |
| 67 | $Al_{98}Co_1Fe_1$ | 420 | 125 | fcc-Al | Duc | Comparative example |
| 68 | $Al_{80}Co_{10}Fe_{10}$ | 1010 | 295 | fcc-Al + Amo | Duc | Example |
| 69 | $Al_{45}Co_{35}Fe_{20}$ | — | 510 | Com | Bri | Comparative example |
| 70 | $Al_{89}Co_{10.7}Fe_{0.3}$ | 390 | 105 | fcc-Al + Amo | Duc | Comparative example |
| 71 | $Al_{98}Co_1Cu_1$ | 320 | 80 | fcc-Al | Duc | Comparative example |
| 72 | $Al_{70}Co_{25}Cu_5$ | 1005 | 325 | fcc-Al + Amo | Duc | Example |
| 73 | $Al_{45}Co_{35}Cu_{20}$ | — | 505 | Com | Bri | Comparative example |
| 74 | $Al_{89.7}Co_{10}Cu_{0.3}$ | 485 | 112 | fcc-Al + Amo | Duc | Comparative example |
| 75 | $Al_{90}Co_9Mn_{0.5}Fe_{0.5}$ | 996 | 305 | fcc-Al + Amo | Duc | Example |

TABLE 6-continued

| Sample No. | Alloy composition (Subscript numerals represent atomic percentage) | σf (MPa) | Hv (DPN) | Structural state | Bending test | |
|---|---|---|---|---|---|---|
| 76 | $Al_{89}Co_8Mn_2Cu_1$ | 1210 | 340 | fcc-Al + Amo | Duc | Example |
| 77 | $Al_{90}Co_7Fe_1Cu_1$ | 1005 | 298 | fcc-Al + Amo | Duc | Example |
| 78 | $Al_{90}Co_7Mn_1Fe_1Cu_1$ | 1230 | 310 | fcc-Al + Amo | Duc | Example |

TABLE 7

| Sample No. | Alloy composition (Subscript numerals represent atomic percentage) | σf (MPa) | Hv (DPN) | Structural state | Bending test | |
|---|---|---|---|---|---|---|
| 79 | $Al_{50}Fe_{40}Mn_{10}$ | — | 560 | Com | Bri | Comparative example |
| 80 | $Al_{60}Fe_{35}Mn_5$ | 845 | 363 | fcc-Al + Amo | Duc | Example |
| 81 | $Al_{65}Fe_{30}Mn_5$ | 960 | 375 | fcc-Al + Amo | Duc | Example |
| 82 | $Al_{70}Fe_{20}Mn_{10}$ | 875 | 340 | fcc-Al + Amo | Duc | Example |
| 83 | $Al_{85}Fe_{10}Mn_5$ | 1070 | 360 | fcc-Al + Amo | Duc | Example |
| 84 | $Al_{95}Fe_{0.5}Mn_{4.5}$ | 910 | 260 | fcc-Al + Amo | Duc | Example |
| 85 | $Al_{94}Fe_{0.3}Mn_{5.7}$ | 480 | 113 | fcc-Al | Duc | Comparative example |
| 86 | $Al_{92}Fe_6Cu_2$ | 1005 | 276 | fcc-Al + Amo | Duc | Example |
| 87 | $Al_{88}Fe_8Cu_4$ | 1210 | 302 | fcc-Al + Amo | Duc | Example |
| 88 | $Al_{45}Fe_{35}Cu_{20}$ | — | 560 | Com | Bri | Comparative example |
| 89 | $Al_{90}Fe_6Mn_2Cu_2$ | 1112 | 293 | fcc-Al + Amo | Duc | Example |
| 90 | $Al_{75}Co_8Mn_5Ti_{12}$ | — | 511 | fcc-Al + Com | Bri | Comparative example |
| 91 | $Al_{76}Fe_4Mn_{10}Ti_{10}$ | 1210 | 370 | fcc-Al + Amo | Duc | Example |
| 92 | $Al_{78}Co_4Fe_{10}Zr_8$ | 1100 | 359 | Amo | Duc | Example |
| 93 | $Al_{78}Fe_8Cu_8Ti_6$ | 1060 | 360 | fcc-Al + Amo | Duc | Example |
| 94 | $Al_{82}Co_8Mn_3Fe_3Zr_4$ | 1090 | 305 | Amo | Duc | Example |
| 95 | $Al_{83}Fe_6Mn_3Cu_6Ti_2$ | 1206 | 328 | fcc-Al + Amo | Duc | Example |
| 96 | $Al_{83}Co_8Mn_4Fe_4Zr_1$ | 1230 | 345 | fcc-Al + Amo | Duc | Example |
| 97 | $Al_{98}Fe_7Cu_{4.5}Ti_{0.5}$ | 1175 | 339 | fcc-Al + Amo | Duc | Example |
| 98 | $Al_{85}Fe_{10}Mn_{4.7}Zr_{0.3}$ | 1049 | 362 | fcc-Al + Amo | Duc | Comparative example |

What is claimed is:

1. High strength and anti-corrosive aluminum-based alloy essentially consisting of an amorphous structure, said aluminum based alloy represented by the general formula $Al_xM_yR_z$, wherein M is at least one metal element selected from the group consisting of Ti, V, Cr, Mn, Fe, Co, Cu, Zr, Nb, Mo and Ni, and R is at least one element selected from the group consisting of Y, Ce, La, Nd and Mm (misch metal); in said formula, x, y and z represent the composition ratio, and are atomic percentages satisfying the relationships of $x+y+z=100$, $64.5 \leqq x \leqq 95$, $5 \leqq y \leqq 35$, and $0<z \leqq 0.4$ and said aluminum-based alloy having a positive value of differential intensity profile for any value of the wave number vector.

2. High strength and anti-corrosive aluminum-based alloy essentially consisting of a multiphase structure essentially consisting of an amorphous component and a fine crystalline component, said aluminum-based alloy represented by the general formula $Al_xM_yR_z$, wherein M is at least one metal element selected from the group consisting of Ti, V, Cr, Mn, Fe, Co, Cu, Zr, Nb, Mo and Ni, and R is at least one element selected from the group consisting of Y, Ce, La, Nd and Mm (misch metal); in said formula, x, y and z represent the composition ratio, and are atomic percentages satisfying the relationships of $x+y+z= 100$, $64.5 \leqq x \leqq 95$, $5<y \leqq 35$, and $0 \leqq z \leqq 0.4$ and said aluminum-based alloy having a positive value of differential intensity profile for any value of the wave number vector.

3. High strength and anti-corrosive aluminum-based alloy essentially consisting of an amorphous structure, said aluminum-based alloy represented by the general formula $Al_xNi_yM'_z$, wherein M' is at least one metal element selected from the group consisting of Ti, V, Mn, Fe, Co, Cu and Zr; in said formula, x, y and z represent the composition ratio, and are atomic percentages satisfying the relationships of $x+y+ z=100$, $50 \leqq x \leqq 95$, $0.5 \leqq y \leqq 35$, and $0.5 \leqq z \leqq 20$ and said aluminum-based alloy having a positive value of differential intensity profile for any value of the wave number vector.

4. High strength and anti-corrosive aluminum-based alloy essentially consisting of a multiphase structure essentially consisting of an amorphous component and a fine crystalline component, said aluminum-based alloy represented by the general formula $Al_xNi_yM'_z$, wherein M' is at least one metal element selected from the group consisting of Ti, V, Mn, Fe, Co, Cu and Zr; in said formula, x, y and z represent the composition ratio, and are atomic percentages satisfying the relationships of $x+y+z=100$, $50 \leqq x \leqq 95$, $0.5 \leqq y \leqq 35$, and $0.5 \leqq z \leqq 20$ and said aluminum-based alloy having a positive value of differential intensity profile for any value of the wave number vector.

5. High strength and anti-corrosive aluminum-based alloy according to claim 2 wherein said fine crystalline component of said multiphase structure comprising at least one phase selected from the group consisting of an aluminum phase, a stable intermetallic compound phase, a metastable intermetallic compound phase, and a metal solid solution comprising an aluminum matrix.

6. High strength and anti-corrosive aluminum-based alloy represented by the general formula $Al_xCo_yM''_z$, wherein M" is at least one metal element selected from the group consisting of Mn, Fe and Cu; in said formula, x, y and z represent the composition ratio, and are atomic percentages satisfying the relationships of $x+y+z=100$, $50 \leqq x \leqq 95$, $0.5 \leqq y \leqq 35$, and $0.5 \leqq z \leqq 20$ and said aluminum-based alloy having a positive value of differential intensity profile for any value of the wave number vector.

7. High strength and anti-corrosive aluminum-based alloy represented by the general formula $Al_aFe_bL_c$, wherein L is at least one metal element selected from the group consisting of Mn and Cu; in said formula, a, b and c represent the composition ratio, and are atomic percentages satisfying the relationships of $a+b+c=100$, $50 \leqq x \leqq 95$, $0.5 \leqq y \leqq 35$, and $0.5 \leqq z \leqq 20$ and said aluminum-based alloy having a positive value of differential intensity profile for any value of the wave number vector.

8. High strength and anti-corrosive aluminum-based alloy according claim 6, wherein up to one-half of the atomic percentage of element M" is substituted by one element selected from the group consisting of Ti and Zr.

9. High strength and anti-corrosive aluminum-based alloy according to claim 7, wherein up to one-half of the atomic percentage of element L is substituted by one element selected from the group consisting of Ti and Zr.

10. High strength and anti-corrosive aluminum-based alloy according to claim 4 wherein said fine crystalline component of said multiphase structure comprising at least one phase selected from the group consisting of an aluminum phase, a stable intermetallic compound phase, a metastable intermetallic compound phase, and a metal solid solution comprising an aluminum matrix.

11. High strength and anti-corrosive aluminum-based alloy according to claim 1, wherein x is at least 87.

12. High strength and anti-corrosive aluminum-based alloy according to claim 2, wherein x is at least 87.

13. High strength and anti-corrosive aluminum-based alloy according to claim 3, wherein x is at least 87.

14. High strength and anti-corrosive aluminum-based alloy according to claim 4, wherein x is at least 87.

15. High strength and anti-corrosive aluminum-based alloy according to claim 6, wherein x is at least 87.

16. High strength and anti-corrosive aluminum-based alloy according to claim 7, wherein x is at least 1273 87.

17. High strength and anti-corrosive aluminum-based alloy according to claim 1, wherein said alloy is selected from the group consisting of $Al_{88}Ni_{11.6}Ce_{0.4}$, $Al_{89.7}Ni_5Fe_5Ce_{0.3}$, $Al_{89.6}Ni_{11.6}Y_{0.4}$, $Al_{87}Ni_{12}Mn$, $Al_{88}Ni_9Co_3$, $Al_{88}Ni_{11}Zr$, $Al_{88}Ni_{11}Fe$, $Al_{89}Co_8Mn_3$, $Al_{90}Co_6Fe_4$, $Al_{90}Co_9Cu$, and $Al_{90}Co_9Mn$.

18. High strength and anti-corrosive aluminum-based alloy according to claim 1, wherein z is O and M is two elements of said group.

* * * * *

UNITED STATES PATENT AND TRADEMARK OFFICE

CERTIFICATE OF CORRECTION

PATENT NO. : 5,509,978
DATED : April 23, 1996
INVENTOR(S) : Tsuyoshi Masumoto, Akihisa Inoue, and Yuma Horio It is certified that error appears in the above-indentified patent and that said Letters Patent is hereby corrected as shown below:

ON THE TITLE PAGE:

Item [73] Assignee: change the identification of the Assignee to read:

--Yamaha Corporation, Tsuyoshi Masumoto, and Akihisa Inoue, all of Japan--.

Signed and Sealed this

Third Day of September, 1996

*Attest:*

*Attesting Officer*

BRUCE LEHMAN

*Commissioner of Patents and Trademarks*